US006686139B2

(12) United States Patent
Kanazawa et al.

(10) Patent No.: US 6,686,139 B2
(45) Date of Patent: Feb. 3, 2004

(54) SILVER HALIDE PHOTOGRAPHIC PHOTOSENSITIVE MATERIAL

(75) Inventors: Katsuhiko Kanazawa, Shizuoka-ken (JP); Terukazu Yanagi, Kanagawa (JP); Yoshihisa Tsukada, Kanagawa (JP); Shinichi Ichikawa, Kanagawa (JP)

(73) Assignee: Fuji Photo Film Co. Ltd., Kanagawa (JP)

( * ) Notice: Subject to any disclaimer, the term of this patent is extended or adjusted under 35 U.S.C. 154(b) by 0 days.

(21) Appl. No.: 10/443,102

(22) Filed: May 22, 2003

(65) Prior Publication Data

US 2003/0235793 A1 Dec. 25, 2003

(30) Foreign Application Priority Data

May 24, 2002 (JP) ..... 2002-150122

(51) Int. Cl.[7] ..... G03C 1/38; G03C 1/85

(52) U.S. Cl. ..... 430/529; 430/523; 430/528; 430/539; 430/634

(58) Field of Search ..... 430/529, 634, 430/528, 523, 539

(56) References Cited

U.S. PATENT DOCUMENTS 4,347,308 A * 8/1982 Takeuchi ..... 430/529
4,847,187 A * 7/1989 Ono et al. ..... 430/529
4,968,599 A * 11/1990 Pitt et al. ..... 430/528
5,254,448 A 10/1993 Yamada et al.
5,411,844 A * 5/1995 Orem ..... 430/528
5,503,967 A * 4/1996 Furlan et al. ..... 430/529
6,589,723 B2 * 7/2003 Yamanouchi et al. ..... 430/529

FOREIGN PATENT DOCUMENTS

JP 2-141739 * 5/1990

* cited by examiner

*Primary Examiner*—Richard L. Schilling
(74) *Attorney, Agent, or Firm*—Tatyo, Nakajima & Kato

(57) ABSTRACT

A silver halide photographic material of the invention contains a support having on at least one surface thereof at least one photosensitive silver halide emulsion layer, and a surface protective layer. The silver halide photographic material of the invention may include a hydrophilic colloid layer containing a hydrophilic colloid, in addition to the surface protective layer. The silver halide photographic material of the invention contains at least two kinds of surfactants that are different from each other. One of the surfactants (type 1) has a fluoroalklyl group or a fluoroalkylene group. The other (type 2) is an anionic surfactant containing ethyleneoxy repeating units and having an alkyloxy group or an alkylcarbonyl group at an end thereof.

13 Claims, No Drawings

SILVER HALIDE PHOTOGRAPHIC PHOTOSENSITIVE MATERIAL

BACKGROUND OF THE INVENTION

1. Field of the Invention

The present invention relates to a silver halide photographic photosensitive material (hereinafter, sometimes simply referred to as a "photosensitive material") and coating property thereof, and in particular, it relates to a photosensitive material that is excellent in high-speed coating suitability and has a coated surface in good condition.

2. Description of the Related Art

Large amounts of various kinds of surfactants have been added in photosensitive materials, and it is an important problem from the standpoint of environmental protection that the total addition amount of the surfactants is reduced. However, the surfactants achieve various functions, and the reduction of the addition amounts thereof brings about such problems caused by increase of surface tension that formation of uniform coated films is failed due to runout of a coating liquid upon high-speed coating, the property of the coated surface is deteriorated, and the dispersion stability of various kinds of additives is deteriorated thereby causing formation of insoluble matters by aggregation of the additives, which results in deterioration in the photograph quality. The high-speed coating suitability deeply relates to the surface tension, and in general, the coating suitability is improved when the surface tension is 35 dyne/cm or less. The surface tension relates to the addition amount of the surfactant, and a large amount thereof is necessarily added for the high-speed coating. As a result, various problems are involved that deterioration of the surface property of the coated film due to formation of aggregated matters, and elution and accumulation of the surfactant in the processing liquid upon development processing causing formation of insoluble matters in the liquid.

SUMMARY OF THE INVENTION

The invention has been made to solve the problems associated with the conventional techniques and to attain the following objects. A first object of the invention is to provide a silver halide photographic photosensitive material, in which the surface tension is effectively reduced by addition of a small amount of a surfactant to obtain solubility and coating property that are sufficiently suitable for production and photographic quality.

Namely, the present invention provides a silver halide photographic photosensitive material comprising a support, a photosensitive silver halide emulsion layer formed on at least one surface of the support, and a surface protective layer formed on the surface of the support, wherein the silver halide photographic photosensitive material contains at least one compound represented by the following general formula (1) and at least one compound represented by the following general formula (2).

General Formula (1)

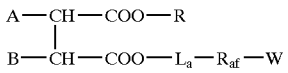

wherein in the general formula (1), R represents an alkyl group substituted with an atom or an atomic group other than fluorine, or an unsubstituted alkyl group; $R_{af}$ represents a perfluoroalkylene group; W represents a hydrogen atom or a fluorine atom; $L_a$ represents an unsubstituted or substituted alkylene group, a substituted or unsubstituted alkyleneoxy group or a divalent group combining these group; one of A and B represents a hydrogen atom, and the other thereof represents —$L_b$—$SO_3M$; M represents a cation or a hydrogen atom; and $L_b$ represents a single bond or a substituted or unsubstituted alkylene group.

General Formula (2)

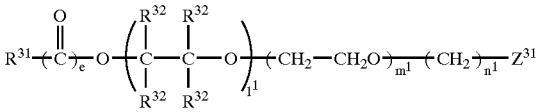

In the general formula (2), $R^{31}$ represents an alkyl group having from 6 to 25 carbon atoms or an alkenyl group having from 6 to 25 carbon atoms; $R^{32}$ may be the same or different with each other and each represents a hydrogen atom, an alkyl group having from 1 to 14 carbon atoms, an alkenyl group having from 1 to 14 carbon atoms, an aralkyl group having from 7 to 20 carbon atoms or an aryl group having from 6 to 18 carbon atoms; $l^1$ represents an integer of from 1 to 10; $m^1$ represents an integer of from 0 to 30; $n^1$ represents an integer of from 0 to 4; e represents an integer of 0 or 1; $Z^{31}$ represents $OSO_3M$ or $SO_3M$; and M represents a cation.

In one aspect, the present invention provides the silver halide photographic photosensitive material, wherein the compound represented by the general formula (1) is a compound represented by the following general formula (3).

General Formula (3)

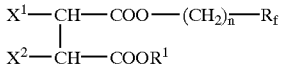

In the general formula (3), $R^1$ represents a substituted or unsubstituted alkyl group having a total carbon number of from 6 to 15, provided that $R^1$ does not represents an alkyl group substituted with a fluorine atom; $R_f$ represents a perfluoroalkyl group having from 1 to 6 carbon atoms; one of $X_1$ and $X_2$ represents a hydrogen atom, and the other thereof represents —$L_b$—$SO_3M$; M represents a cation or a hydrogen atom; $L_b$ represents a single bond or a substituted or unsubstituted alkylene group; and n represents an integer of from 1 to 8.

In another aspect, the present invention provides the silver halide photographic photosensitive material, wherein $R^f$ in the general formula (3) is a perfluoroalkyl group having from 2 to 4 carbon atoms.

Further, the present invention provides a silver halide photographic photosensitive material comprising a support, a photosensitive silver halide emulsion layer formed on at least one surface of the support, and a surface protective layer formed on the surface of the support, wherein the silver halide photographic photosensitive material contains at least one compound represented by the following general formula (A) and at least one compound represented by the following general formula (2).

General Formula (A)

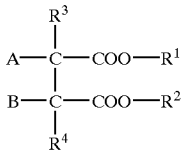

In the general formula (A), $R^1$ and $R^2$ each independently represent a fluoroalkyl group having from 2 to 6 carbon atoms and from 1 to 11 fluorine atoms; $R^3$ and $R^4$ each independently represents a hydrogen atom or an alkyl group; one of A and B represents a hydrogen atom, and the other represents $—L_b—SO_3M$; M represents a hydrogen atom or a cation; and $L_b$ represents a single bond or a substituted or unsubstituted alkylene group.

General Formula (2)

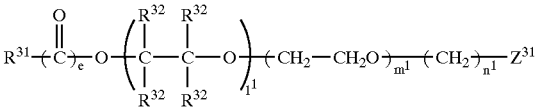

In the general formula (2), $R^{31}$ represents an alkyl group having from 6 to 25 carbon atoms or an alkenyl group having from 6 to 25 carbon atoms; $R^{32}$ may be the same or different and each represents a hydrogen atom, an alkyl group having from 1 to 14 carbon atoms, an alkenyl group having from 1 to 14 carbon atoms, an aralkyl group having from 7 to 20 carbon atoms or an aryl group having from 6 to 18 carbon atoms; $1^1$ represents an integer of from 1 to 10; $m^1$ represents an integer of from 0 to 30; $n^1$ represents an integer of from 0 to 4; e represents an integer of 0 or 1; $Z^{31}$ represents $OSO_3M$ or $SO_3M$; and M represents a cation.

In another aspect, the present invention provides the silver halide photographic photosensitive material, wherein at least one of a front surface and a back surface has a surface electric resistance of from $10^{10}\Omega$ to $10^{15}\Omega$.

Further, in another aspect, the present invention provides the silver halide photographic photosensitive material, wherein at least one of the surface protective layer and a hydrophilic colloid layer, that is other than the surface protective layer, contains at least one nonionic surfactant represented by the following general formula (4):

$$R'—(A—(B)_n—R)_m$$ General Formula (4)

In the general formula (4), m represents an integer of 1 or 2; n represents an integer of from 1 to 60; R represents a hydrogen atom or a linear or branched alkyl group having from 1 to 4 carbon atoms; R' represents a substituted or unsubstituted alkyl group having from 1 to 30 carbon atoms, a substituted or unsubstituted alkenyl group having from 1 to 30 carbon atoms, or a substituted or unsubstituted aryl group having from 1 to 30 carbon atoms; A represents —O—, —S—, —COO—, $—N(R_1)—$, $—CO—N(R_1)—$ or $—SO_2—N(R_1)—$; $R_1$ represents a hydrogen atom or a substituted or unsubstituted alkyl group; and B represents an oxyalkylene group.

DETAILED DESCRIPTION OF THE INVENTION

The invention will be described in detail below.

The silver halide photographic material of the invention contains a support having on at least one surface thereof at least one photosensitive silver halide emulsion layer, and a surface protective layer. The silver halide photographic material of the invention may comprise a hydrophilic colloid layer, that comprises a hydrophilic colloid and is a different layer from the surface protective layer. The silver halide photographic material of the invention contains at least two kinds of surfactants that are different from each other. One of the surfactants (hereinafter, referred to as type 1) is one having a fluorcalklyl group or a fluoroalkylene group. The other thereof (hereinafter, referred to as type 2) is an anionic surfactant containing ethyleneoxy repeating units and having an alkyloxy group or an alkylcarbonyl group at an end thereof. Preferably, the silver halide photographic material of the invention contains the type 1 and type 2 surfactants in at least one of the surface protective layer and the hydrophilic colloid layer.

The surfactants will be described in detail below.

1. Surfactant 1-1. Surfactant of Type 1

The surfactant of type 1 of the invention is a fluorine surfactant and is represented by the general formula (1), the general formula (3) or the general formula (A).

(1) Surfactant Represented by General Formula (1)

The surfactant represented by the general formula (1) will be firstly described.

General Formula (1)

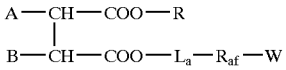

In the general formula (1), R represents an alkyl group substituted with an atom or an atomic group other than fluorine, or an unsubstituted alkyl group. The substituted or unsubstituted alkyl group represented by R may be linear or branched, or may have a cyclic structure. The substituent is not limited and is preferably an alkenyl group, an aryl group, an alkoxy group, a halogen atom (preferably a chlorine atom), a carboxylate ester group, a carbonamide group, a carbamoyl group, an oxycarbamoyl group and a phosphate ester group. R is more preferably an unsubstituted alkyl group. The group represented by R preferably has from 2 to 30 carbon atoms, from 4 to 20 carbon atoms, and further preferably from 6 to 15 carbon atoms.

In the general formula (1), $R_{af}$ represents a perfluoroalkylene group. The perfluoroalkylene group herein is a group obtained by substituting all hydrogen atoms of an alkylene group by fluorine atoms. The perfluoroalkylene group may be linear or branched, or may have a cyclic structure. The group represented by $R_{af}$ preferably has 10 or less carbon atoms, and more preferably 8 or less carbon atoms.

In the general formula (1), W represents a hydrogen atom or a fluorine atom, and preferably a fluorine atom. In the general formula (1), one of A and B represents a hydrogen atom, and the other thereof represents $—L_b—SO_3M$.

M represents a cation. Preferred examples of the cation represented by M include an alkali metal ion (such as a lithium ion, a sodium ion and a potassium ion), an alkaline earth metal ion (such as a barium ion and a calcium ion) and an ammonium ion. Among these, a lithium ion, a sodium ion, a potassium ion and an ammonium ion are preferred, and a lithium ion, a sodium ion and a potassium ion are more preferred, which can be appropriately selected depending on the total number of carbon atoms, the substituents and the extent of branch of the alkyl group of the surfactant represented by the general formula (1). In the case where the total carbon number of R, $L_a$ and $R_{af}$ is 16 or more, in particular, the use of a lithium ion is excellent from the standpoint of improvements of both the solubility (particularly in water) and the antistatic function or the coating uniformity.

$L_b$ represents a single bond or a substituted or unsubstituted alkylene group. Examples of the substituent therefor include those described for R. In the case where $L_b$ represents an alkylene group, it preferably has a carbon number or 2 or less and preferably unsubstituted, and it is more preferably a methylene group. $L_b$ most preferably represents a single bond.

In the surfactant represented by the general formula (1) it is preferred that the preferred embodiments of R, $R_{af}$, $L_a$, A and B are combined.

(2) Surfactant Represented by General Formula (3)

In the surfactant represented by the general formula (1), a surfactant represented by the following general formula (3) is particularly preferred.

General Formula (3)

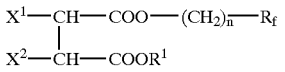

In the general formula (3), $R^1$ represents a substituted or unsubstituted alkyl group having a total carbon number of 6 or more, provided that $R^1$ does not represents an alkyl group substituted with a fluorine atom. The substituted or unsubstituted alkyl group represented by $R^1$ may be linear or branched, or may have a cyclic structure. Examples of the substituent include an alkenyl group, an aryl group, an alkoxy group, a halogen atom other than a fluorine atom, a carboxylate ester group, a carbonamide group, a carbamoyl group, an oxycarbonyl group and a phosphate ester group.

In the general formula (3), the substituted or unsubstituted alkyl group represented by $R^1$ preferably has a total carbon number of from 6 to 24. Preferred examples of the unsubstituted alkyl group having from 6 to 24 carbon atoms include a n-hexyl group, a n-heptyl group, a n-octyl group, a tert-octyl group, a 2-ethylhexyl group, a n-nonyl group, a 1,1,3-trimethylhexyl group, a n-decyl group, a n-dodecyl group, a cetyl group, a hexadecyl group, a 2-hexyldecyl group, an octadecyl group, an eicosyl group, a 2-octyldodecyl group, a docosyl group, tetracosyl group, 2-decyltetradecyl group, a tricosyl group, a cyclohexyl group and a cycloheptyl group. Preferred examples of the substituted alkyl group having a total carbon number including that of the substituent of from 6 to 24 include a 2-hexenyl group, an oleyl group, a linoleyl group, a linolenyl group, a benzyl group, a β-phenethyl group, a 2-methoxyethyl group, a 4-phenylbutyl group, a 4-acetoxyethyl group, a 6-phenoxyhexyl group, a 12-phenyldodecyl group, a 18-phenyloctadecyl group, a 12-(p-chlorophenyl)dodecyl group and a 2-(diphenylphosphate)ethyl group.

In the general formula (3), the substituted or unsubstituted alkyl group represented by $R^1$ more preferably has a total carbon number of from 6 to 18. Preferred examples of the unsubstituted alkyl group having from 6 to 18 carbon atoms include a n-hexyl group, a cyclohexyl group, a n-heptyl group, a n-octyl group, a 2-ethylhexyl group, a n-nonyl group, a 1,1,3-trimethylhexyl group, a n-decyl group, a n-dodecyl group, a cetyl group, a hexadecyl group, a 2-hexyldecyl group, an octadecyl group and a 4-tert-butylcyclohexyl group. Preferred examples of the substituted alkyl group having a total carbon number of from 6 to 18 include a phenethyl group, a 6-phenoxyhexyl group, a 12-phenyldodecyl group, an oleyl group, a linoleyl group and linolenyl group. Among these, $R^1$ preferably represents a n-hexyl group, a cyclohexyl group, a n-heptyl group, a n-octyl group, a 2-ethylhexyl group, a n-nonyl group, a 1,1,3-trimethylhexyl group, a n-decyl group, a n-dodecyl group, a cetyl group, a hexadecyl group, a 2-hexyldecyl group, an octadecyl group, an oleyl group, a linoleyl group and a linolenyl group, and particularly preferably represents a linear, cyclic or branched unsubstituted alkyl group having from 8 to 16 carbon atoms.

In the general formula (3), $R_f$ represents a perfluoroalkyl group having 6 or less carbon atoms. The perfluoroalkyl group herein is a group obtained by substituting all hydrogen atoms of an alkyl group by fluorine atoms. The alkyl group in the perfluoroalkyl group may be linear or branched, or may have a cyclic structure. Examples of the perfluoroalkyl group represented by $R_f$ include a trifluoromethyl group, a pentafluoroethyl group, a heptafluoro-n-propyl group, a heptafluoroisopropyl group, a nonafluoro-n-pentyl group, an undecafluoro-n-pentyl group, a tridecafluoro-n-hexyl group and an undecafluorocyclohexyl group. Among these, a perfluoroalkyl group having from 2 to 4 carbon atoms is preferred (such as a pentafluoroethyl group, a heptafluoro-n-propyl group heptafluoroisopropyl group and a nonafluoro-n-butyl group), and a heptafluoro-n-propyl group and a nonafluoro-n-butyl group are particularly preferred. In particular, $R^f$ preferably represents a perfluoroalkyl group having from 2 to 4 carbon atoms.

In the general formula (3), n represents an integer of 1 or more, preferably an integer of from 1 to 4, and particularly preferably an integer of 1 or 2. As a combination of n and $R_f$, $R_f$ more preferably represents a heptafluoro-n-propyl group or a nonafluoro-n-butyl group in the case of n=1, and $R_f$ more preferably represents a nonafluoro-n-butyl group in the case of n=2.

In the general formula (3), one of $X_1$ and $X_2$ represents a hydrogen atom, and the other thereof represents $—L_b—SO_3M$, wherein M represents a cation. Preferred examples of the cation represented by M include an alkali metal cation (such as a lithium ion, a sodium ion and a potassium ion), an alkaline earth metal ion (such as a barium ion and a calcium ion) and an ammonium ion. Among these, a lithium ion, a sodium ion, a potassium ion and an ammonium ion are preferred. $L_b$ represents a single bond or a substituted or unsubstituted alkylene group. Examples of the substituent therefor include those described for R. In the case where $L_b$ represents an alkylene group, it preferably has a carbon number or 2 or less and preferably unsubstituted, and it is more preferably a methylene group. $L_b$ most preferably represents a single bond.

The fluoroalkyl group or the fluoroalkylene group in the invention is particularly preferably a fluoroalkyl group represented by the following general formula (FA1):

$$—L_a—R_{af}—W \qquad \text{General Formula (FA1)}$$

In the general formula (FA1), $L_a$ represents a substituted or unsubstituted alkylene group, a substituted or unsubstituted alkyleneoxy group or a divalent group formed with a combination of these groups. The substituent is not limited and is preferably an alkenyl group, an aryl group, an alkoxy group, a halogen atom (preferably a chlorine atom), a carboxylate ester group, a carbonamide group, a carbamoyl group, an oxycarbamoyl group and a phosphate ester group.

$L_a$ preferably has 8 or less carbon atoms, and more preferably 4 or less carbon atoms. An unsubstituted alkylene group is preferred. $R_{af}$ represents a perfluoroalkyl group having from 1 to 5 carbon atoms, and preferably a perfluoroalkyl group having from 2 to 4 carbon atoms. The perfluoroalkylene group herein is a group obtained by substituting all hydrogen atoms of an alkylene group by fluorine atoms. The perfluoroalkylene group may be linear or branched, or may have a cyclic structure. W represents a hydrogen atom, a fluorine atom or an alkyl group, and preferably a hydrogen atom or a fluorine atom.

$R_{af}$ most preferably represents a perfluoroalkylene group having 4 carbon atoms. In the case where a fluorine compound in the invention is a mixture of compounds having different carbon numbers of $R_{af}$, it is preferred that the proportion of the compound having a carbon number of $R_{af}$ of 4 (C4 compound) is larger.

The proportion of the C4 compound in the mixture is preferably 20% or more, more preferably 50% or more, further preferably 80% or more, and particularly preferably 90% or more. The reason thereof is that the solubility in water is deteriorated in the case where a compound having a group represented by $R_{af}$ having 6 or more carbon atoms is contained in a large amount, and thus the proportion of C6 or more compounds is preferably small, whereas the effect of decreasing the static surface tension is small in comparison to the C4 compound in the case where a compound having a group represented by $R_{af}$ having 3 or less carbon atoms is contained in a large amount, and thus the proportion of C3 or less compounds is preferably small.

The anionic hydrophilic group is an acidic group having pKa of 7 or less and an alkali metal salt or an ammonium salt thereof. Specific examples thereof include a sulfo group, a carboxyl group, a phosphonic acid group, a carbamoylsulfamoyl group, a sulfamoylsulfamoyl group, an acylsulfamoyl group and salts thereof. Among these, a sulfo group, a carboxyl group, a phosphonic acid group and salts thereof are preferred, and a sulfo group and a salt thereof are more preferred. Examples of a cationic species forming the salt include lithium, sodium, potassium, cesium, ammonium, tetramethylammonium, tetrabutylammonium and methylpyridinium, and lithium, sodium, potassium and ammonium are preferred. The nonionic hydrophilic group is preferably a hydroxyl group and a polyalkyleneoxy group, and a polyalkyleneoxy group is preferred.

The polyalkyleneoxy group and the anionic hydrophilic group may be simultaneously present in one molecule, which is a preferred structure in the invention.

It is also effective that both the anionic compound and the nonionic compounds are used in combination, which is particularly preferred in the invention.

Specific examples of the fluoroalkyl group used in the invention include the following group, but the invention is not limited thereto.

Examples include a $—C_2F_5$ group, a $—C_3F_7$ group, a $—C_4F_9$ group, a $—C_5F_{11}$ group, a $—CH_2—C_4F_9$ group, a $—C_4F_8—H$ group, a $—C_2H_4—C_4F_9$ group, a $—C_4H_8—C_4F_9$ group, a $—C_6H_{12}—C_4F_9$ group, a $—C_8H_{16}—C_4F_9$ group, a $—C_4H_8—C_2F_5$ group, a $C_4H_8—C_3F_7$ group, a $—C_4H_8—C_5F_{11}$ group, a $—C_8H_{16}—C_2F_5$ group, a $—C_2H_4—C_4F_8—H$ group, a $—C_4H_8—C_4F_8—H$ group, a $—C_6H_{12}—C_4F_8—H$ group, a $—C_6H_{12}—C_2F_4—H$ group, a $—C_8H_{16}—C_2F_4—H$ group, a $—C_6H_{12}—C_4F_8—CH_3$ group, a $—C_2H_4—C_3F_7$ group, a $—C_2H_4—C_5H_{11}$ group, a $—C_4H_8—CF(CF_3)_2$ group, a $—CH_2CF_3$ group, a $—C_4H_8—CH(C_2F_5)_2$ group, a $—C_4H_8—CH(CF_3)_2$ group and a $—C_4H_8—C(CF_3)_3$ group.

(3) Surfactant Represented by General Formula (A)

A more preferred fluorine compound in the invention is represented by the following general formula (A).

General Formula (A)

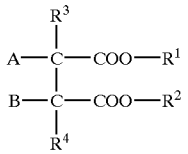

In the general formula (A), $R^1$ and $R^2$ each independently represents a fluoroalkyl group having 2 or more carbon atoms and 11 or less fluorine atoms, and $R^3$ and $R^4$each independently represents a hydrogen atom or a substituted or unsubstituted alkyl group.

Specific examples of the fluoroalkyl group represented by $R^1$ and $R^2$ include those exemplified in the foregoing, and preferred examples thereof include structures represented by the general formula (1). Preferred structure among these is also the same as those described for the fluoroalkyl group in the foregoing.

The substituted or unsubstituted alkyl group represented by $R^3$ and $R^4$ may be linear or branched, or may have a cyclic structure. The substituent is not limited and is preferably an alkenyl group, an aryl group, an alkoxy group, a halogen atom (preferably a chlorine atom), a carboxylate ester group, a carbonamide group, a carbamoyl group, an oxycarbamoyl group and a phosphate ester group.

One of A and B represents a hydrogen atom, and the other thereof represents $—L_b—SO_3M$, wherein M represents a cation. Preferred examples of the cation represented by M include an alkali metal cation (such as a lithium ion, a sodium ion and a potassium ion), an alkaline earth metal ion (such as a barium ion and a calcium ion) and an ammonium ion. Among these, a lithium ion, a sodium ion, a potassium ion and an ammonium ion are preferred, and a lithium ion, a sodium ion and a potassium ion are more preferred, which can be appropriately selected depending on the total number of carbon atoms, the substituents and the extent of branch of the alkyl group of the compound represented by the general formula (A). In the case where the total carbon number of $R^1$, $R^2$, $R^3$ and $R^4$ is 16 or more, the use of a lithium ion is excellent from the standpoint of improvements of both the solubility (particularly in water) and the antistatic function or the coating uniformity.

$L_b$ represents a single bond or a substituted or unsubstituted alkylene group. Examples of the substituent therefor include those described for $R_3$. In the case where $L_b$ represents an alkylene group, it preferably has a carbon number or 2 or less and preferably unsubstituted, and it is more preferably a methylene group. $L_b$ most preferably represents a methylene group or a single bond.

In the compound represented by the general formula (1), it is preferred that the foregoing preferred embodiments are combined.

(4) Surfactant Represented by General Formula (B)

In the surfactant represented by the general formula (A), a surfactant represented by the following general formula (B) is particularly preferred.

General Formula (B)

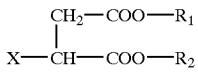

In the general formula (B), $R_1$ and $R_2$ each independently represents a fluoroalkyl group represented by the following general formula (1)'.

$$—L_a—R_{af}—W \quad (1)'$$

In the general formula (1)', $L_a$ represents a substituted or unsubstituted alkylene group, a substituted or unsubstituted alkyleneoxy group or a divalent group formed with a combination of these groups. The substituent is not limited and is preferably an alkenyl group, an aryl group, an alkoxy group, a halogen atom (preferably a chlorine atom), a carboxylate ester group, a carbonamide group, a carbamoyl group, an oxycarbamoyl group and a phosphate ester group.

$L_a$ preferably has 8 or less carbon atoms, and more preferably 4 or less carbon atoms. An unsubstituted alkylene group is preferred. $R_{af}$ represents a perfluoroalkylene group having from 1 to 5 carbon atoms, and preferably a perfluoroalkyl group having from 2 to 4 carbon atoms. The perfluoroalkylene group herein is a group obtained by substituting all hydrogen atoms of an alkylene group by fluorine atoms. The perfluoroalkylene group may be linear or branched, or may have a cyclic structure. W represents a hydrogen atom, a fluorine atom or an alkyl group, and preferably a hydrogen atom or a fluorine atom.

In the general formula (B), X represents —$L_b$—$SO_3M$, and $L_b$ represents a methylene group or a single bond. M represents a cation. Preferred examples of a cation represented by M include an alkali metal ion (such as a lithium ion, a sodium ion and a potassium ion), an alkaline earth metal ion (such as a barium ion and a calcium ion) and an ammonium ion. Among these, a lithium ion, a sodium ion, a potassium ion and an ammonium ion are preferred.

Specific examples of the fluorine compound of the invention will be described below, but the invention is not limited to the specific examples.

In the structural expressions of the following specific examples, the alkyl groups and the perfluoroalkyl groups are those having linear structures unless otherwise indicated.

FS-1

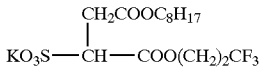

FS-2

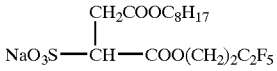

FS-3

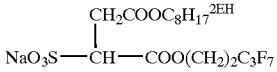

FS-4

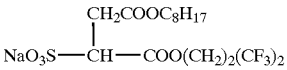

FS-5

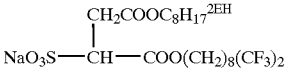

FS-6

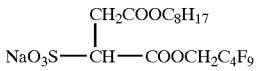

FS-7

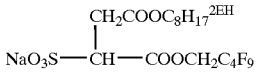

FS-8

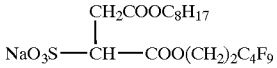

FS-9

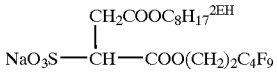

-continued

FS-10

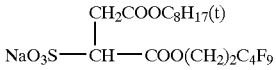

FS-11

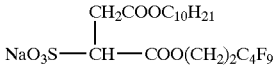

FS-12

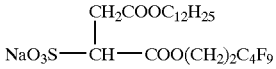

FS-13

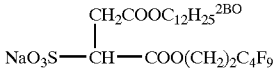

FS-14

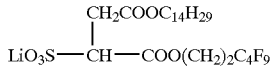

(FSA-15)

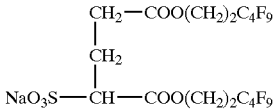

(FSA-16)

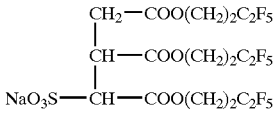

(FSA-17)

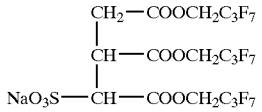

(FSA-18)

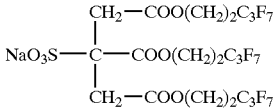

(FSA-19)

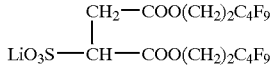

(FSA-20)

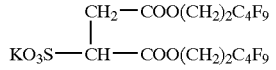

(FSA-21)

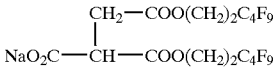

(FSA-22)

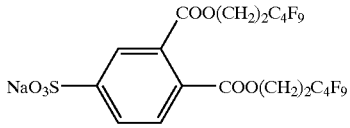

(FSA-23)

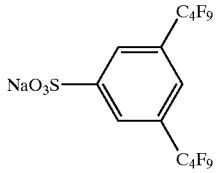

(FSA-24)

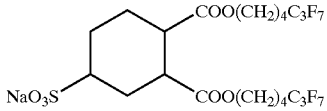

-continued
(FSA-25)
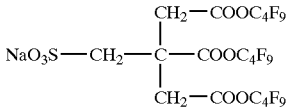
(FSA-26)
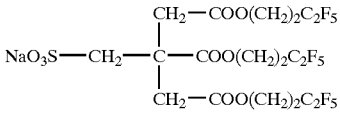
(FSA-27)
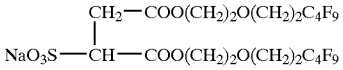
(FSA-28)
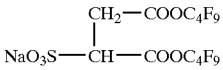
(FSA-29)
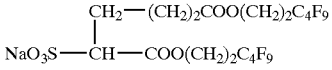
(FSA-30)
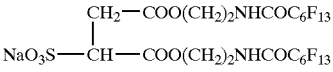
(FSA-31)
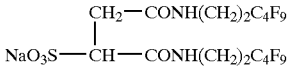
(FSA-32)
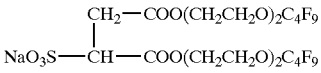
(FSA-33)
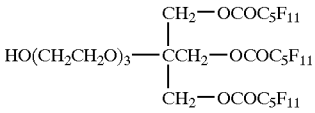
(FSA-34)
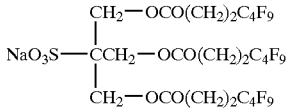
(FSA-35)
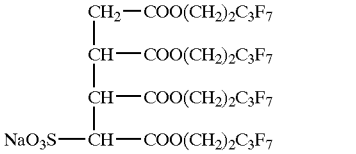
(FSA-36)
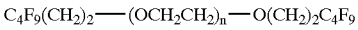
n = 5~10
(FSA-37)
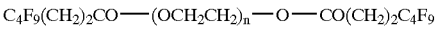
n = 5~10
(FSA-38)
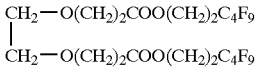
(FSA-39)
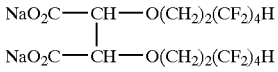
(FSA-40)
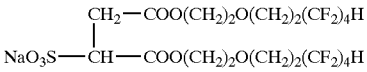
-continued
(FSA-41)
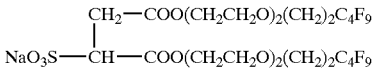
(FSA-42)
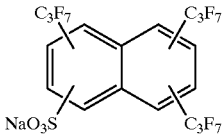
(FSA-43)
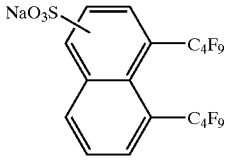
(FSA-44)
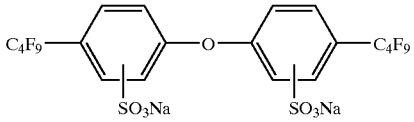
(FSA-45)
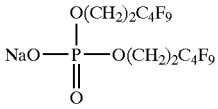
(FSA-46)
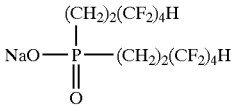
(FSA-47)
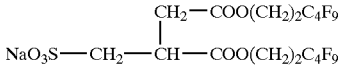
(FSA-48)
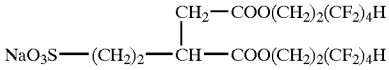
(FSA-49)
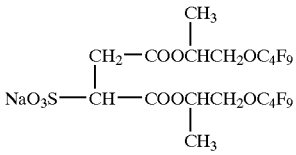
(FSA-50)
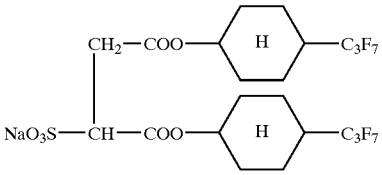
FS-51
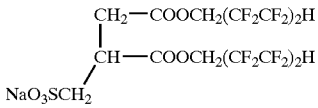
FS-52
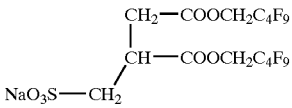

-continued

FS-53

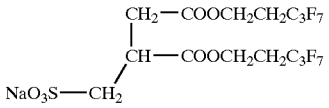

FS-54

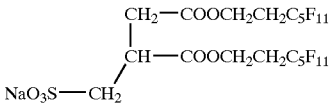

FS-55

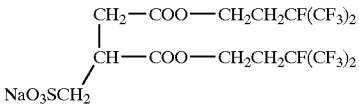

FS-56

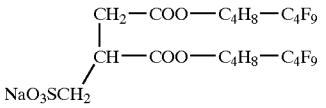

FS-57

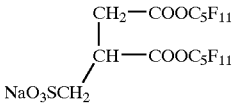

FS-58

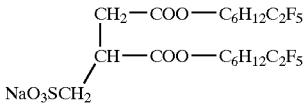

FS-59

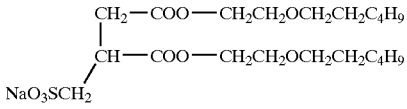

FS-60

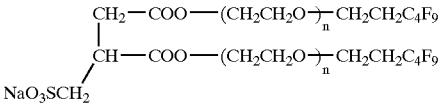

n = 5 ~ 10

FS-61

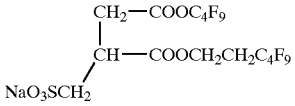

FS-62

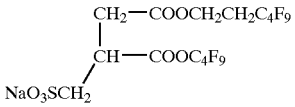

FS-63

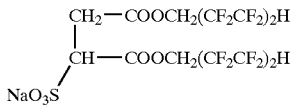

FS-64

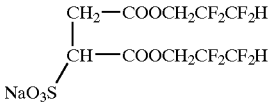

FS-65

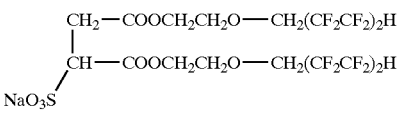

-continued

FS-66

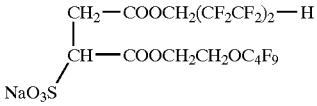

The fluorine compound represented by the general formula (A) and (B) can be conveniently synthesized by combining an ordinary esterification reaction and an ordinary sulfonation reaction.

The surfactant of type 1 described in the foregoing can be conveniently synthesized, for example, by combining an ordinary esterification reaction and an ordinary sulfonation reaction.

The surfactant of type 1 may be used solely, or two or more of them may be used in combination.

The surfactant of type 1 may be added to an arbitrary layer in the photosensitive material. Examples of the layer, to which it is added, include a photosensitive layer (emulsion layer), an intermediate layer, a surface protective layer, a back layer and a back surface protective layer. Among these, it is preferably used in the outermost layer, such as a surface protective layer and a back surface protective layer. The using amount of the surfactant of type 1 in each of the front surface and the back surface is preferably in a range of from 0.01 to 200 mg/m$^2$, more preferably from 0.05 to 50 mg/m$^2$, and further preferably from 0.1 to 30 mg/m$^2$.

In the case where the surfactant is coated in the invention, an aqueous coating composition containing the surfactant may contain only the surfactant of the invention and water, or may appropriately contain other components depending on purpose.

1-2. Surfactant of Type 2

The surfactant of type 2 used in the invention is represented by the following general formula (2).

General Formula (2)

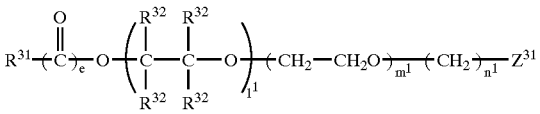

wherein $R^{31}$ represents an alkyl group having from 6 to 25 carbon atoms or an alkenyl group having from 6 to 25 carbon atoms; $R^{32}$ may be the same or different and each represents a hydrogen atom, an alkyl group having from 1 to 14 carbon atoms, an alkenyl group having from 1 to 14 carbon atoms, an aralkyl group having from 7 to 20 carbon atoms or an aryl group having from 6 to 18 carbon atoms; $l^1$ represents an integer of from 1 to 10; $m^1$ represents an integer of from 0 to 30; $n^1$ represents an integer of from 0 to 4; e represents an integer of 0 or 1; $Z^{31}$ represents $OSO_3M$ or $SO_3M$; and M represents a cation.

In the general formula (2), $R^{31}$ represents an alkyl group having from 6 to 25 carbon atoms or an alkenyl group having from 6 to 25 carbon atoms. The carbon number of $R^{31}$ is preferably 6 to 22, preferably from 6 to 20, and particularly preferably from 8 to 18. The alkyl group and the alkenyl group are preferably a linear alkyl group and a linear alkenyl group, respectively, while they may have a cyclic structure. The alkyl group and the alkenyl group are preferably an unsubstituted alkyl group and an unsubstituted alkenyl group, while they may have a substituent. The linear alkyl group and the linear alkenyl group may have a branch. The position of the double bond in the alkenyl group is not particularly limited. The alkyl group is preferred in comparison to the alkenyl group.

In the general formula (2), $R^{32}$ may be the same or different and each represents a hydrogen atom, an alkyl group having from 1 to 14 carbon atoms, an alkenyl group having from 1 to 14 carbon atoms, an aralkyl group having from 7 to 20 carbon atoms or an aryl group having from 6 to 18 carbon atoms. The alkyl group and the alkenyl group preferably have a carbon number of from 1 to 8, more preferably from 1 to 6, and particularly preferably from 1 to 4. The aralkyl group preferably has a carbon number of from 7 to 13, and particularly preferably from 7 to 10. The aryl group preferably has a carbon number of from 6 to 12, and particularly preferably from 6 to 10.

In the general formula (2), the groups represented by $R^{32}$ may be combined with each other to form a cyclic structure. The group represented by $R^{32}$ may further have a substituent, and preferred examples of the substituent will be shown below.

Preferred examples of the substituent include a halogen atom (such as a fluorine atom, a chlorine atom and a bromine atom), an alkyl group (such as methyl, ethyl, isopropyl, n-propyl and t-butyl), an alkenyl group (such as allyl and 2-butenyl), an alkynyl group (such as propargyl), an aralkyl group (such as benzyl), an aryl group (such as phenyl and naphthyl), a hydroxyl group, an alkoxy group (such as methoxy, ethoxy, butoxy and ethoxyethoxy) and an aryloxy group (such as phenoxy and 2-naphthyloxy).

$R^{32}$ preferably represents a hydrogen atom or an alkyl group having from 1 to 8 carbon atoms, more preferably a hydrogen atom or an alkyl group having from 1 to 6 carbon atoms, further preferably a hydrogen atom or an alkyl group having from 1 to 4 carbon atoms, and particularly preferably a hydrogen atom, a methyl group or a hydroxymethyl group.

In the general formula (2), $1^1$ represents an integer of from 1 to 10, preferably from 1 to 8, more preferably from 1 to 6, and particularly preferably 1 to 4.

In the general formula (2), $m^1$ represents an integer of from 0 to 30, preferably from 0 to 25, more preferably from 0 to 20, and particularly preferably from 0 to 15.

In the general formula (2), $n^1$ represents an integer of from 0 to 4, and particularly preferably from 2 to 4.

In the general formula (2), $Z^{31}$ represents $OSO_3M$ or $SO_3M$, and M represents a cation. Preferred examples of the cation represented by M include an alkali metal ion (such as a lithium ion, a sodium ion and a potassium ion), an alkaline earth metal ion (such as a barium ion and a calcium ion) and an ammonium ion. Among these, a lithium ion, a sodium ion, a potassium ion and an ammonium ion are particularly preferred.

In the general formula (2), e represents an integer of 0 or 1.

Specific examples of the compound represented by the general formula (2) will be shown below, but the invention is not limited to the specific examples.

| | | |
|---|---|---|
| WS-1 | $C_6H_{13}$—O—$(CH_2CH_2O)_n$—$(CH_2)_2$—$SO_3Na$ | n = 0 to 12 |
| WS-2 | $C_6H_{13}$—O—$(CH_2CH_2O)_n$—$(CH_2)_3$—$SO_3Na$ | n = 0 to 12 |
| WS-3 | $C_6H_{13}$—O—$(CH_2CH_2O)_n$—$(CH_2)_4$—$SO_3Na$ | n = 0 to 12 |
| WS-4 | $C_8H_{17}$—O—$(CH_2CH_2O)_n$—$(CH_2)_2$—$SO_3Na$ | n = 0 to 12 |
| WS-5 | $C_8H_{17}$—O—$(CH_2CH_2O)_n$—$(CH_2)_3$—$SO_3Na$ | n = 0 to 12 |
| WS-6 | $C_8H_{17}$—O—$(CH_2CH_2O)_n$—$(CH_2)_4$—$SO_3Na$ | n = 0 to 12 |
| WS-7 | $C_{10}H_{21}$—O—$(CH_2CH_2O)_n$—$(CH_2)_2$—$SO_3Na$ | n = 0 to 12 |
| WS-8 | $C_{10}H_{21}$—O—$(CH_2CH_2O)_n$—$(CH_2)_3$—$SO_3Na$ | n = 0 to 12 |
| WS-9 | $C_{10}H_{21}$—O—$(CH_2CH_2O)_n$—$(CH_2)_4$—$SO_3Na$ | n = 0 to 12 |
| WS-10 | $C_6H_{21}$—O—$(CH_2CHO)_n$—$(CH_2)_2$—$SO_3K$ | n = 0 to 12 |
| WS-11 | $C_{10}H_{21}$—O—$(CH_2CH_2O)_n$—$(CH_2)_4$—$SO_3NH_3$ | n = 0 to 12 |
| WS-12 | $C_{11}H_{23}$—O—$(CH_2CH_2O)_n$—$(CH_2)_2$—$SO_3Na$ | n = 0 to 12 |
| WS-13 | $C_{11}H_{23}$—O—$(CH_2CH_2O)_n$—$(CH_2)_3$—$SO_3Na$ | n = 0 to 12 |
| WS-14 | $C_{11}H_{23}$—O—$(CH_2CH_2O)_n$—$(CH_2)_4$—$SO_3Na$ | n = O to 12 |
| WS-15 | $C_{12}H_{25}$—O—$(CH_2CH_2O)_n$—$(CH_2)_2$—$SO_3Na$ | n = 0 to 20 |
| WS-16 | $C_{12}H_{25}$—O—$(CH_2CH_2O)_n$—$(CH_2)_3$—$SO_3Na$ | n = 0 to 20 |
| WS-17 | $C_{12}H_{25}$—O—$(CH_2CH_2O)_n$—$(CH_2)_4$—$SO_3Na$ | n = 0 to 20 |
| WS-18 | $C_{14}H_{29}$—O—$(CH_2CH_2O)_n$—$(CH_2)_2$—$SO_3Na$ | n = 0 to 25 |
| WS-19 | $C_{14}H_{29}$—O—$(CH_2CH_2O)_n$—$(CH_2)_3$—$SO_3Na$ | n = 0 to 25 |
| WS-20 | $C_{14}H_{29}$—O—$(CH_2CH_2O)_n$—$(CH_2)_4$—$SO_3Na$ | n = 0 to 25 |
| WS-21 | $C_{16}H_{33}$—O—$(CH_2CH_2O)_n$—$(CH_2)_3$—$SO_3NH_3$ | n = 0 to 30 |
| WS-22 | $C_{16}H_{33}$—O—$(CH_2CH_2O)_n$—$(CH_2)_4$—$SO_3Na$ | n = 0 to 30 |
| WS-23 | $C_{18}H_{37}$—O—$(CH_2CH_2O)_n$—$(CH_2)_3$—$SO_3Na$ | n = 0 to 30 |
| WS-24 | $C_{18}H_{37}$—O—$(CH_2CH_2O)_n$—$(CH_2)_4$—$SO_3Na$ | n = 0 to 30 |
| WS-25 | $C_{20}H_{41}$—O—$(CH_2CH_2O)_n$—$(CH_2)_4$—$SO_3Na$ | n = 0 to 30 |
| WS-26 | $C_8H_{17}CH{=}C_8H_{15}$—O—$(CH_2CH_2O)_n$—$(CH_2)_2$—$SO_3Na$ | n = 0 to 30 |
| WS-27 | $C_{22}H_{45}$—O—$(CH_2CH_2O)_n$—$(CH_2)_2$—$SO_3Na$ | n = 0 to 30 |
| WS-28 | $C_{24}H_{49}$—O—$(CH_2CH_2O)_n$—$(CH_2)_2$—$SO_3Na$ | n = 0 to 30 |
| WS-29 | $C_{24}H_{49}$—O—$(CH_2CH_2O)_n$—$(CH_2)_2$—$SO_3Li$ | n = 0 to 30 |
| WS-30 | $C_6H_{13}$—O—$(CH_2CH_2O)_n$—$OSO_3Na$ | n = 0 to 12 |
| WS-31 | $C_8H_{17}$—O—$(CH_2CH_2O)_n$—$SO_3Na$ | n = 0 to 12 |
| WS-32 | $C_9H_{19}$—O—$(CH_2CH_2O)_n$—$SO_3Na$ | n = 0 to 12 |
| WS-33 | $C_{10}H_{21}$—O—$(CH_2CH_2O)_n$—$SO_3Na$ | n = 0 to 12 |
| WS-34 | $C_{11}H_{23}$—O—$(CH_2CH_2O)_n$—$SO_3Na$ | n = 0 to 12 |
| WS-35 | $C_{12}H_{25}$—O—$(CH_2CH_2O)_n$—$SO_3Na$ | n = 0 to 12 |
| WS-36 | $C_{14}H_{29}$—O—$(CH_2CH_2O)_n$—$SO_3Na$ | n = 0 to 20 |
| WS-37 | $C_{16}H_{33}$—O—$(CH_2CH_2O)_n$—$SO_3Na$ | n = 0 to 25 |
| WS-38 | $C_{18}H_{37}$—O—$(CH_2CH_2O)_n$—$SO_3Na$ | n = 0 to 30 |
| WS-39 | $C_{18}H_{37}$—O—$(CH_2CH_2O)_n$—$SO_3K$ | n = 0 to 30 |
| WS-40 | $C_{18}H_{37}$—O—$(CH_2CH_2O)_n$—$SO_3Li$ | n = 0 to 30 |
| WS-41 | $C_7H_{15}C({=}O)O$—$(CH_2CH_2O)_2$—$(CH_2)_2$—$SO_3Na$ | |
| WS-42 | $C_9H_{19}C({=}O)O$—$(CH_2CH_2O)_4$—$(CH_2)_2$—$SO_3Na$ | |
| WS-43 | $C_9H_{19}C({=}O)O$—$(CH_2CH_2O)_6$—$(CH_2)_3$—$SO_3Na$ | |

-continued

| | | |
|---|---|---|
| WS-44 | $C_9H_{19}C(=O)O—(CH_2CH_2O)_8—(CH_2)_4—SO_3Na$ | |
| WS-45 | $C_{11}H_{23}C(=O)O—(CH_2CH_2O)_{15}(CH_2)_2—SO_3Na$ | |
| WS-46 | $C_8H_{17}CH=C_7H_{13}C(=O)O—(CH_2CH_2O)_{15}—(CH_2)_3—SO_3Na$ | |
| WS-47 | $C_{21}H_{43}C(=O)O—(CH_2CH_2O)_{20}—(CH_2)_2—SO_3Na$ | |
| WS-48 | $C_8H_{17}—O—(CH(CH_3)—CH_2—O)_l(CH_2—CH_2—O)_m(CH_2)_2—SO_3Na$ | I = 1~5, m = 0~5 |
| WS-49 | $C_{10}H_{21}—O—(CH(CH_3)—CH_2—O)_l(CH_2—CH_2—O)_m(CH_2)_2—SO_3Na$ | I = 1~5, m = 0~8 |
| WS-50 | $C_{10}H_{21}—O—(CH(CH_3)—CH_2—O)_l(CH_2—CH_2—O)_m(CH_2)_4—SO_3Na$ | I = 1~5, m = 0~8 |
| WS-60 | $C_{12}H_{25}—O—(CH(CH_3)—CH_2—O)_l(CH_2—CH_2—O)_m(CH_2)_2—SO_3Na$ | I = 1~5, m = 0~10 |
| WS-61 | $C_{12}H_{25}—O—(CH(CH_3)—CH_2—O)_l(CH_2—CH_2—O)_m(CH_2)_4—SO_3Na$ | I = 1~5, m = 0~10 |
| WS-62 | $C_{14}H_{29}—O—(CH(CH_3)—CH_2—O)_l(CH_2—CH_2—O)_m(CH_2)_2—SO_3Na$ | I = 1~5, m = 0~10 |
| WS-63 | $C_{14}H_{29}—O—(CH(CH_3)—CH_2—O)_l(CH_2—CH_2—O)_m(CH_2)_4—SO_3Na$ | I = 1~5, m = 0~10 |
| WS-64 | $C_{16}H_{33}—O—(CH(CH_3)—CH_2—O)_l(CH_2—CH_2—O)_m(CH_2)_2—SO_3Na$ | I = 1~5, m = 0~12 |
| WS-65 | $C_{16}H_{33}—O—(CH(CH_3)—CH_2—O)_l(CH_2—CH_2—O)_m(CH_2)_4—SO_3Na$ | I = 1~5, m = 0~12 |
| WS-66 | $C_{18}H_{37}—O—(CH(CH_3)—CH_2—O)_l(CH_2—CH_2—O)_m(CH_2)_4—SO_3Na$ | I = 1~5, m = 0~12 |
| WS-67 | $C_{20}H_{41}—O—(CH(CH_3)—CH_2—O)_l(CH_2—CH_2—O)_m(CH_2)_4—SO_3Na$ | I = 1~5, m = 0~15 |
| WS-68 | $C_{22}H_{45}—O—(CH(CH_3)—CH_2—O)_l(CH_2—CH_2—O)_m(CH_2)_4—SO_3Na$ | I = 1~5, m = 0~15 |
| WS-69 | $C_{15}H_{31}—O—(CH(CH_3)—CH_2—O)_l(CH_2—CH_2—O)_m(CH_2)_4—SO_3Na$ | I = 1~5, m = 0~10 |
| WS-70 | $C_{13}H_{27}—O—(CH(CH_3)—CH_2—O)_l(CH_2—CH_2—O)_m(CH_2)_4—SO_3Na$ | I = 1~5, m = 0~8 |
| WS-71 | $C_{11}H_{23}—O—(CH(CH_3)—CH_2—O)_l(CH_2—CH_2—O)_m(CH_2)_2—SO_3Na$ | I = 1~5, m = 0~5 |
| WS-72 | $C_{12}H_{25}—C(=O)—O—(CH(CH_3)—CH_2—O)_l(CH_2—CH_2—O)_m(CH_2)_4—SO_3Na$ | I = 1~5, m = 0~5 |

-continued

| | | |
|---|---|---|
| WS-73 | $C_{14}H_{29}-C(=O)-O-(CH(CH_3)-CH_2-O)_l-(CH_2-CH_2-O)_m-(CH_2)_4-SO_3Na$ | I = 1~5, m = 0~10 |
| WS-74 | $C_{16}H_{33}-C(=O)-O-(CH(CH_3)-CH_2-O)_l-(CH_2-CH_2-O)_m-(CH_2)_4-SO_3Na$ | I = 1~5, m = 0~10 |
| WS-75 | $C_{12}H_{25}-C(=O)-O-(CH(CH_3)-CH_2-O)_l-(CH_2-CH_2-O)_m-(CH_2)_2-SO_3Na$ | I = 1~5, m = 0~10 |
| WS-76 | $C_{14}H_{29}-C(=O)-O-(CH(CH_3)-CH_2-O)_l-(CH_2-CH_2-O)_m-(CH_2)_2-SO_3Na$ | I = 1~5, m = 0~10 |
| WS-77 | $C_{16}H_{33}-C(=O)-O-(CH(CH_3)-CH_2-O)_l-(CH_2-CH_2-O)_m-(CH_2)_2-SO_3Na$ | I = 1~5, m = 0~10 |
| WS-78 | $C_{22}H_{43}-C(=O)-O-(CH(CH_3)-CH_2-O)_l-(CH_2-CH_2-O)_m-(CH_2)_4-SO_3Na$ | I = 1~5, m = 0~10 |
| WS-79 | $C_{20}H_{41}-C(=O)-O-(CH(CH_3)-CH_2-O)_l-(CH_2-CH_2-O)_m-(CH_2)_4-SO_3Na$ | I = 1~5, m = 0~10 |
| WS-80 | $C_{10}H_{21}-C(=O)-O-(CH(CH_3)-CH_2-O)_l-(CH_2-CH_2-O)_m-(CH_2)_4-SO_3Na$ | I = 1~5, m = 0~10 |
| WS-81 | $C_{18}H_{37}-C(=O)-O-(CH(CH_3)-CH_2-O)_l-(CH_2-CH_2-O)_m-(CH_2)_4-SO_3Na$ | I = 1~5, m = 0~10 |

The compound represented by the general formula (2) can be synthesized by a known method as described, for example, in JP-A No. 2001-3263, *"J. Amer. Chem. Soc."*, vol. 65, p. 2196 (1943), *"J. Phys. Chem."*, vol. 90, p. 2413 (1986), *"J. Dispersion Sci. and Tech."*, vol. 4, p. 361 (1983) and U.S. Pat. No. 5,602,087.

In the invention, the surfactant of type 2 may be used solely, or two or more of them may be used in combination. The surfactant of type 2 may be added to an arbitrary layer in the photosensitive material. Examples of the layer, to which it is added, include a photosensitive layer (emulsion layer), an intermediate layer, a surface protective layer, a back layer and a back surface protective layer, and among these, it is particularly preferably used in a surface protective layer or a back surface protective layer. The using amount of the surfactant of type 2 in each of the front surface and the back surface of the photosensitive material is preferably in a range of from 0.1 to 300 mg/m$^2$, more preferably from 1 to 200 mg/m$^2$, and further preferably from 5 to 100 mg/m$^2$.

In the invention, a ratio of a fluorescent X-ray intensity of fluorine to a fluorescent X-ray intensity of carbon (F/C) on at least one of the front surface and the back surface of the silver halide photosensitive material is preferably from 0.01 to 10, and more preferably from 0.01 to 3.

1-3. Other Surfactants

The silver halide photosensitive material of the invention may contain at least one particular surfactant containing from 20 to 80% by weight of an oxyalkylene part (hereinafter, referred to as type 3) depending on necessity.

The surfactant of type 3 is particularly preferably a compound (a nonionic surfactant) represented by the following general formula (4).

$$R'-(A-(B)_n-R)_m \qquad \text{General Formula (4)}$$

In the general formula (4), m represents an integer of 1 or 2; n represents an integer of from 1 to 60; R represents a hydrogen atom or a linear or branched alkyl group having from 1 to 4 carbon atoms (such as a methyl group, an ethyl group, a hydroxyethyl group and an isopropyl group); R' represents a substituted or unsubstituted alkyl group having from 1 to 30 carbon atoms, an alkenyl group or an aryl group; A represents —O—, —S—, —COO—, —N($R_1$)—, —CO—N($R_1$)— or —$SO_2$—N($R_1$)—; $R_1$ represents a hydrogen atom or a substituted or unsubstituted alkyl group; and B represents an oxyalkylene group (such as an oxyethylene group, an oxypropylene group, an oxyhydroxypropylene group and an oxybutylene group), and preferably represents an oxyethylene group or an oxyhydroxypropylene group.

In the group represented by R' in the general formula (4), a hydrogen atom in the alkyl group may be substituted with a fluorine atom.

Specific examples of the surfactant represented by the general formula (4) will be shown below, but the invention is not limited to the specific examples.

P-1 $C_8H_{17}O(CH_2CH_2O)_7H$
P-2 $C_{12}H_{25}O(CH_2CH_2O)_{10}H$
P-3 $C_{16}H_{33}O(CH_2CH_2O)_{15}H$
P-4 $C_{15}H_{31}O(CH_2CH(OH)CH_2O)_2(CH_2CH_2O)_7H$
P-5 $C_{18}H_{37}O(CH_2CH_2O)_2(CH_2CH(OH)CH_2O)_2(CH_2CH_2O)_4H$
P-6 $C_{11}H_{23}COO(CH_2CH_2O)_8H$
P-7 $C_{15}H_{31}COO(CH_2CH_2O)_{13}H$
P-8 $C_{16}H_{33}COO(CH_2CH_2O)_{15}H$
P-9 $C_{18}H_{35}COO(CH_2CH_2O)_{15}H$
P-10 $C_{12}H_{25}S(CH_2CH_2O)_{15}H$
P-11 $C_8H_{17}SO_2N(C_3H_7)(CH_2CH_2O)_{10}H$
P-12 $C_{10}H_{21}SO_2N(C_3H_7)(CH_2CH_2O)_{13}H$
P-13 $C_{12}H_{25}SO_2N(C_3H_7)(CH_2CH_2O)_{15}H$
P-14 $C_4F_9CH_2CH_2O(CH_2CH_2O)_7H$
P-15 $C_6F_{13}CH_2CH_2O(CH_2CH_2O)_{10}H$
P-16 $C_8F_{17}CH_2CH_2O(CH_2CH_2O)_{20}H$
P-17 $C_8F_{17}SO_2N(C_3H_7)(CH_2CH_2O)_{10}H$
P-18 $C_{10}F_{21}SO_2N(C_3H_7)(CH_2CH_2O)_{13}H$
P-19 $C_{12}F_{25}SO_2N(C_3H_7)(CH_2CH_2O)_{15}H$

P-20

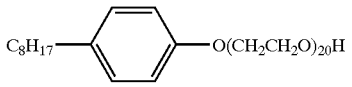

P-21

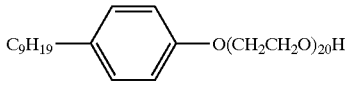

P-22

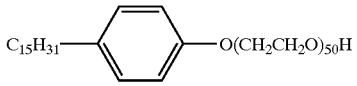

P-23

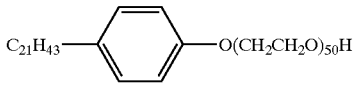

P-24

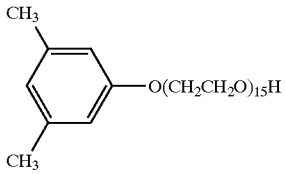

-continued

P-25

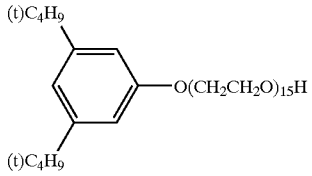

P-26

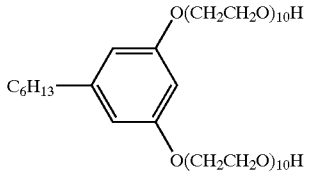

P-27

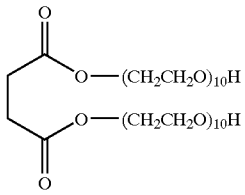

P-28

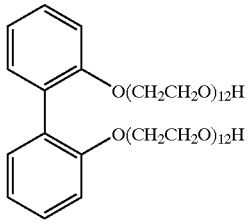

2. Silver Halide Emulsion

The silver halide emulsion used in the invention will be described below.

(1) Halogen Composition

The photosensitive silver halide particles may be silver chloride, silver bromochloride, silver bromide, silver bromoiodide or silver bromochloroiodide, and from the standpoint of the expedited processing as described in the foregoing, the iodine amount in average contained in the photosensitive silver halide particles is from 0 to 0.45% by mole. The iodine amount in average is preferably from 0.05 to 0.40% by mole, and more preferably from 0.10 to 0.30% by mole. The term "average" of the iodine amount contained in the photosensitive silver halide particles means an average value of the iodine contents obtained from the halogen compositions of the respective photosensitive silver halide particles. The distribution of the halogen composition inside the particles of the photosensitive silver halide may be uniform, or in alternative, the halogen composition may be stepwise changed or continuously changed. As the photosensitive silver halide particles, photosensitive silver halide particles having a core/shell structure may be used.

(2) Shape, Size, and Formation Method of Photosensitive Silver Halide Particles

Preferred examples of the photosensitive silver halide particles include particles of the so-called halogen conversion type (conversion type particles) as described in British Patent No. 635,841 and U.S. Pat. No. 3,622,318. The halogen conversion is generally carried out by adding a halogen aqueous solution having a smaller solubility product constant with silver than the halogen composition on the particle surface before the halogen conversion. For example, an aqueous solution of a potassium bromide and/or potassium iodide is added to silver chloride or silver bromochloride tabular particles, or an aqueous solution of potassium iodide is added to silver bromide or silver bromoiodide tabular particles, so as to carry out the conversion. The concentration of the aqueous solutions is preferably as small as possible, and it is preferably 30% or less, and more preferably 10% or less. It is preferred that the conversion halogen solution is added at a rate of 1% by mole per minute per 1 mole of the silver halide before the halogen conversion. A part or the whole of a sensitizing dye and/or a silver halide adsorbing substance may be present on the halogen conversion, and silver halide fine particles of silver bromide, silver bromoiodide or silver iodide may be added instead of the conversion halogen aqueous solution. The size of the fine particles is generally 0.2 μm or less, preferably 0.1 μm or less, and particularly preferably 0.05 μm or less. The halogen conversion method that can be used in the invention is not limited to the foregoing method, and various methods may be used in combination depending on purposes.

The formation method of the photosensitive silver halide particles have been well known in the art, and they can be prepared in a method described, for example, in JP-A No. 2-68539, U.S. Pat. No. 3,700,458and *"Research Disclosure"*, No. 17029, June of 1978.

(4) Chemical Sensitization Method

As the chemical sensitization method, those disclosed in JP-A No. 2-68539, page 10, right upper column, line 13 to left lower column, line 16, and JP-A Nos. 5-313282 and6-110144 may be used.

As the method for chemical sensitization of the silver halide emulsion, specifically, those known methods in the presence of a silver halide absorbing substance, as a sulfur sensitization method, a selenium sensitization method, a reduction sensitization method and a gold sensitization method, may be used solely or in combination.

The gold sensitization method is a representative example of a noble metal sensitization method and mainly uses a gold complex salt. Other noble metal than gold, such as platinum, palladium and iridium, may be contained without any problem. Specific examples thereof are disclosed in U.S. Pat. No. 2,448,060 and British Patent No. 618,061.

Examples of the sulfur sensitizing agent include, in addition to a sulfur compound contained in gelatin, various sulfur compounds, such as a thiosulfate, a thiourea compound, a thiazole compound and a rhodanine compound. Specific examples thereof are disclosed in U.S. Pat. Nos. 1,574,944, 2,278,947, 2,410,689, 2,728,668, 5,501,313 and 8,656,955. Examples of the selenium sensitizing agent are disclosed in JP-A No. 6-110144.

The combination use of the sulfur sensitization by a thiosulfate with the selenium sensitization and the gold sensitization is useful. Examples of the reduction sensitizing agent include a stannous salt, an amine compound, formaminedisulfinic acid and a silane compound.

(5) Fog Preventing Agent and Stabilizing Agent

Examples of a fog preventing agent and a stabilizing agent that can be used in the invention include those disclosed in JP-A No. 2-68539, page 10, left lower column, line 17 to page 11, left upper column, line 7 and page 3, left lower column, line 2 to page 4, left lower column.

Specifically, those compounds that have been known as a fog preventing agent and a stabilizing agent may be added, examples of which include an azole compound (such as a benzothiazolium salt, a nitroimidazole compound, a nitrobenzimidazole compound, a chlorobenzimidazole compound, chromobenzimidazole compound, a nitroindazole compound, a benzotriazole compound and an aminotriazole compound); a mercapto compound (such as a mercaptothiazole compound, a mercaptobenzthiazole compound, a mercaptobenzimidazole compound, a mercaptothiadiazole compound, a mercaptotetrazole compound, a mercaptopyrimidine compound and a mercaptotriazine compound); a thioketo compound, such as oxadrinthione; an azaindene compound (such as a triazaindene compound, a tetrazaindene compound (particularly, 4-hydroxy-substituted (1,3,3a,7)tetrazaindene) and a pentazaindene compound); benzenethiosulfonic acid; benzenesulfinic acid and benzenesulfonic acid amide.

In particular, nitrone and a derivative thereof disclosed in JP-A Nos. 60-76743 and 60-87322, a mercapto composed disclosed in JP-A No. 60-80839, and a heterocyclic compound and a complex salt of a heterocyclic compound with an acid (such as a 1-phenyl-5-mercaptotetrazole compound) disclosed in JP-A No. 57-164735 are preferably used.

Furthermore, a purine compound, a nucleic acid compound, polymer compounds disclosed in JP-B No. 61-36213 and JP-A No. 59-90844 may also be used. Among these, an azaindene compound, a purine compound and a nucleic acid compound are preferably used. The addition amount of the compound is generally from 0.5 to 5.0 mmole, and preferably from 0.5 to 3.0 mmole, per mole of silver halide.

(6) Tone Improving Agent

Examples of a tone improving agent that can be used in the invention include those described in JP-A No. 62-276539, page 2, left lower column, line 7 to page 10, left lower column, line 20, and JP-A No. 3-94249, page 6, left lower column, line 15 to page 11, right upper column, line 19.

Specifically, assuming that the hiding power of the silver halide photographic emulsion layer is 60 or more, it is possible that a dye having a maximum absorption wavelength in a range of from 520 to 560 nm and a dye having a maximum absorption wavelength in a range of from 570 to 700 nm are added in the silver halide photographic emulsion layer and/or the other layers to such an amount that an increment of optical density in transmission density of the unexposed part after the developing process due to the presence of the dye is 0.03 or less.

Examples of an emulsion that provide a hiding power of the silver halide photographic emulsion layer of 60 or more include a tabular emulsion and a fine particle emulsion. In particular, a large effect can be obtained in tone improvement in the case where the silver halide photographic emulsion is constituted with tabular silver halide emulsion particles having a particle thickness of 0.4 μm or less, or in the case where such a mixed emulsion is used that contains a high iodine content surface photosensitive emulsion and an emulsion containing fine particles internally fogged.

Examples of dyes that can be used for improving tone in the invention include a combination of a dye having a maximum absorption wavelength in a range of from 520 to 560 nm, preferably from 530 to 555 nm, and a dye having a maximum absorption wavelength in a range of from 570 to 700 nm, preferably from 580 to 650 nm. The maximum absorption wavelength herein means a maximum absorption wavelength of a dye that is in a state where the dye is contained in the photosensitive material.

Examples of the dye used in the invention include those having the prescribed maximum absorption wavelength selected from an anthraquinone dye, an azo dye, an azomethine dye, an indoaniline dye, an oxonole dye, a carbocyanine dye, a styryl dye and a triphenylmethane dye. Preferred examples thereof are selected from an anthraquinone dye, an azo dye, an azomethine dye and an indoaniline dye under consideration of stability to development processing, light fastness, and influence on photographic performance, such as desensitization, fogging and stain. Preferred compounds are described in JP-A No. 62-276539, page 3, left upper column, line 5 to page 9, left upper column, line 9.

The dye can be dispersed in an emulsion layer and other hydrophilic colloid layers (such as an intermediate layer, a protective layer, an antihalation layer and a filter layer) by various kinds of known methods, which are specifically described in JP-A No. 62-276539, page 9, left upper column, line 14 to page 10, left lower column, line 20.

(7) Spectral Sensitizing Dye

Examples of a spectral sensitizing dye that can be used in the invention include those described in JP-A No. 2-68539, page 4, right lower column, line 4 to page 8, right lower column.

Specific examples thereof include a cyanine dye, a merocyanine dye, a complex cyanine dye, a complex merocyanine dye, a holopolananine dye, a styryl dye, a hemicyanine dye, an oxonole dye and a hemioxonole dye.

Examples of useful sensitizing dyes used in the invention include those described in U.S. Pat. Nos. 3,522,052, 3,617,197, 3,713,828, 3,615,643, 3,615,632, 3,617,239, 3,628,964, 3,703,377, 3,666,480, 3,667,960, 3,679,428, 3,672,897, 3,769,026, 3,556,800, 3,615,613, 3,613,638, 3,615,635, 3,705,809, 3,632,349, 3,677,765, 3,770,449, 3,770,440, 3,769,025, 3,745,014, 3,713,826, 3,567,458, 3,625,698, 2,526,632 and 2,503,776, JP-A No. 48-76525 and Belgian Patent No. 691,807. The addition amount of the sensitizing dye is generally 0.5 mmole or more and less than 4 mmole, and preferably 0.5 mmole or more and less than 1.5 mmole, per 1 mole of silver halide.

Specific examples of the sensitizing dye include compounds II-1 to II-47 disclosed in JP-A No. 2-68539, pages 5 to 8.

(8) Antistatic Agent

Surfactants described in JP-A No. 2-68539, page 11, left upper column, line 14 to page 12, left upper column, line 9 may be used in the invention as a coating assistant, an antistatic agent or a charge controlling agent.

Specific examples of the surfactant used for these purposes include a nonionic surfactant, such as saponin (steroid series), an alkyleneoxide derivative (e.g., polyethylene glycol, a polyethylene glycol/polypropylene glycol condensate, a polyethylene glycol alkyl ether or polyethylene glycol alkylaryl ether and a polyethyleneoxide compound of silicone) and an alkyl ester of sugar; an anionic surfactant, such as an alkyl sulfonate salt, an alkyl benzenesulfonate salt, an alkyl naphthalenesulfonate salt, an alkyl sulfate ester, an N-acyl-N-alkyltaurine compound, a sulfosuccinate ester and a sulfoalkylpolyoxyethylene alkylphenyl ether; an amphoteric surfactant, such as an alkylbetaine compound and an alkylsulfobetaine compound; and a cationic surfactant, such as an aliphatic or aromatic quaternary ammonium salt, a pyridinium salt and an imidazolium salt.

Among these, anionic surfactants including saponin, sodium dodecylbenzenesulfonate, sodium di-2-ethylhexyl-α-sulfosuccinate, sodium p-octylphenoxyethoxyethanesulfonate, sodium dodecylsulfate, sodium triisopropylnaphthalenesulfonate and sodium N-methyloleyltaurine; cationic surfactants including dodecyltrimethylammonium chloride, N-oleyl-N',N',N'-trimethylammoniodiaminopropane bromide and dodecylpyridinium chloride; betaine surfactants including N-dodecyl-N,N-dimethylcarboxybetaine and N-oleyl-N,N-dimethylsulfobutylbetaine; and nonionic surfactants including polyoxyethylene cetyl ether (average polymerization degree n=10), polyoxyethylene p-nonylphenol ether (n=25) and bis(1-polyoxyethylene-oxy-2,4-di-t-pentylphenyl) ethane (n=15) are particularly preferably used.

Nonionic surfactants, alkali metal nitrates, electroconductive tin oxide, zinc oxide and vanadium pentaoxide or a complex oxide thereof doped with antimony described in JP-A Nos. 60-80848, 61-112144, 62-172343 and 62-173459 can be preferably used as an antistatic agent.

(9) Matting Agent, Lubricating Agent and Plasticizer

Examples of a matting agent, a lubricating agent and a plasticizer that can be used in the invention include those described in JP-A No. 2-68539, page 12, left upper column, line 10to right upper column, line 10, and page 14, left lower column, line 10 to right lower column line 1.

Specifically, fine particles of a homopolymer of polymethyl methacrylate, a copolymer of methyl methacrylate and meth acrylic acid, an organic compound, such as starch, and an inorganic compound, such as silica, titanium dioxide, sulfate and strontium barium, as described in U.S. Pat. Nos. 2,992,101, 2,701,245, 4,142,894 and 4,396,706 can be used. The particle size thereof is generally from 1.0 to 10 μm, and particularly preferably from 2 to 5 μm.

The surface layer of the photosensitive material of the invention may contain, as a lubricating agent, silicone compounds described in U.S. Pat. Nos. 3,489,576 and 4,047,958 and colloidal silica described in JP-B No. 56-23139, and in addition, paraffin wax, a higher fatty acid ester and a starch derivative.

The hydrophilic colloid layers of the silver halide photographic photosensitive material of the invention may contain, as a plasticizer, a polyol compound, such as trimethylolpropane, pentanediol, butanediol, ethylene glycol and glycerin. The emulsion layer of the silver halide photographic photosensitive material of the invention may contain a plasticizer, such as a polymer and an emulsified product, for improving pressure characteristics.

For example, a method using a heterocyclic compound is described in British Patent No. 738,618, a method using an alkyl phthalate is described in British Patent No. 738,637, a method using an alkyl ester is described in British Patent No. 738,639, a method using a polyhydric alcohol is described in U.S. Pat. No. 2,960,404, a method using carboxyalkylcellulose is described in U.S. Pat. No. 3,121,060, a method using paraffin and a carboxylate is described in JP-A No. 49-5017, and a method using an alkyl acrylate and an organic acid is described in JP-B No. 53-28086, which can be used in the invention.

(10) Hydrophilic Colloid

The use of gelatin is advantageous as a binder or a protective colloid that can be used in the emulsion layer, the intermediate layer and the surface protective layer of the silver halide photographic photosensitive material of the invention, and other hydrophilic colloids may be used.

Examples of the hydrophilic colloid that can be used in the invention include those described in JP-A No. 2-68539, page 12, right upper column, line 11 to left lower column, line 16.

For example, protein, such as a gelatin derivative, a graft polymer of gelatin with another polymer albumin and casein; a cellulose derivative, such as hydroxyethyl cellulose, carboxymethyl cellulose and cellulose sulfate ester; a sugar derivative, such as sodium alginate, dextran and a starch derivative; and various kinds of synthetic hydrophilic polymer substances including a homopolymer and a copolymer, such as polyvinyl alcohol, polyvinyl partially acetal, poly-N-vinylpyrrolidone, polyacrylic acid, polymethacrylic acid, polyacrylamide, polyvinylimidazole and polyvinylpyrazole.

As the gelatin, acid-treated gelatin and enzyme-treated gelatin can be used in addition to lime-treated gelatin, and a hydrolysate and an enzymatic decomposition product of gelatin can also be used.

Among these, it is preferred that dextran or polyacrylamide having an average molecular weight of 100,000 or less is used in combination with gelatin. Methods described in JP-A Nos. 63-68887 and 63-149641 are effective in the invention.

(11) Film Hardener

The photographic emulsions and the nonphotosensitive hydrophilic colloids used in the invention may contain an inorganic or organic film hardener. Examples of the film hardener that can be used in the invention include those described in JP-A No. 2-68539, page 12, left lower column, line 17 to page 13, right upper column, line 6.

Specific examples thereof include a chromium salt (such as chrome alum and chromium acetate), an aldehyde compound (such as formaldehyde, glyoxal and glutaraldehyde), an N-methylol compound (such as dimethylol urea and methylol dimethylhydantoin), a dioxane derivative (such as 2,3-dihydroxydioxane), an active vinyl compound (such as 1,3,5-triacryloyl-hexahydro-s-triazine, bis(vinylsulfonyl) methyl ether and N,N'-methylenebis(β-(vinylsulfonyl) propyonamide), an active halogen compound (such as 2,4-dichloro-6-hydroxy-s-triazine), a mucohalogen acid (such as mucochloric acid and mucophenoxychloric acid), an isoxazole compound, dialdehyde starch and 2-chloro-6-hydroxytriazinyl gelatin, which can be used solely or in combination of them. Among these, active vinyl compounds described in JP-A Nos. 53-41221, 53-57257, 59-162546 and 60-80846, and active halogen compounds described in U.S. Pat. No. 3,325,287 are preferred.

A polymer film hardener can also be effectively utilized in the invention. Examples of the polymer film hardener include a polymer having an aldehyde group, such as dialdehyde starch, polyacrolein and an acrolein copolymer described in U.S. Pat. No. 3,396,029, a polymer having an epoxy group described in U.S. Pat. No. 3,623,878, a polymer having a dichlorotriazine group described in U.S. Pat. No. 3,362,827 and "*Research Disclosure*", No. 17333 (1978), a polymer having an active ester group described in JP-A No. 56-66841, and a polymer having an active vinyl group or a group to be a precursor thereof described in JP-A No. 56-142524, U.S. Pat. No. 4,161,407, JP-A No. 54-65033 and "*Research Disclosure*", No. 16725 (1978). Among these, the polymer having an active vinyl group or a group to be a precursor thereof is preferred, and a polymer having an active vinyl group or a group to be a precursor thereof connected to a main chain through a long spacer is particularly preferred.

The hydrophilic colloid layers in the silver halide photographic photosensitive material of the invention are preferably hardened with the film hardener to have a swelling ratio in water of 300% or less, and particularly 230% or less.

(12) Support

Examples of a support used in the invention include those described in JP-A No. 2-68539, page 13, right upper column, lines 7 to 20. Specifically, a polyethylene terephthalate film and a cellulose triacetate film are preferred.

In order to improve the adhesion strength between the support and the hydrophilic colloid layer, it is preferred that the surface thereof is subjected to a corona discharge treatment, a glow discharge treatment or an ultraviolet ray irradiation treatment, or in alternative, an underlayer formed, for example, with a styrene-butadiene latex or a vinylidene chloride latex, on which a gelatin layer may be further provided.

An under layer formed by using an organic solvent containing a polyethylene swelling agent and gelatin may be provided. These underlayers can be further improved in adhesion strength to the hydrophilic colloid layer by adding a surface treatment.

(13) Crossover Cut Method

It has been well known in this field of art that crossover light largely deteriorates the sharpness. As a method for decreasing crossover light of a photographic photosensitive material to 12% or less, U.S. Pat. No. 4,130,429 and JP-A No. 61-116354 disclose a method of absorbing light having a wavelength that agrees with the light emission wavelength of an X-ray fluorescent screen by using a sensitizing colorant or a dye.

Furthermore, U.S. Pat. No. 4,800,150 discloses such a technique that a dye in the form of a fine crystalline dispersion is provided between a support and an emulsion layer to decrease crossover light to 10% or less. JP-A No. 63-305345 discloses such a technique that an anionic dye is fixed to a particular layer by using a cationic polymer latex, and JP-A No. 1-166031 discloses such a technique that a fixing layer for a dye is used as an underlayer. While all the methods may be used in the invention, a colored layer with a dye is preferably an underlayer, and it is preferred that the dye is fixed by the method described in JP-A No. 1-166031, particularly the dye in the form of a fine crystalline dispersion described in U.S. Pat. No. 4,800,150 is fixed to an underlayer. These methods may be used in appropriate combination in the invention.

Examples of the dye that can be preferably used in the invention include those described in JP-A No. 2-264944, page 4, left lower column to page 9, right upper column.

As a mordant layer, those described in JP-A No. 2-264944, page 9, right lower column to page 14, right upper column can be used.

(14) Polyhydroxybenzene Compound

Examples of a polyhydroxybenzene compound that can be used in the invention include those described in JP-A No. 3-39948, page 11, left upper column to page 12, left lower column and EP-A No. 452,772A.

Specific examples thereof include the compound represented by the general formula (III) described in JP-A No. 8-39948, page 11, left upper column and the specific examples thereof, i.e., the compounds (III)-1 to (III)-25 described in the same publication, page 11, left lower column to page 12, left lower column.

The addition amount of the polyhydroxybenzene compound may be less than $5\times10^{-1}$ mole per mole of silver halide, and preferably from $1\times10^{-1}$ to $5\times10^{-3}$ mole per mole of silver halide.

The silver halide photographic photosensitive material of the invention contains a support having thereon a silver halide emulsion layer (photosensitive layer) containing photosensitive silver halide particles with at least one nonphotosensitive hydrophilic colloid layer, for example, an intermediate layer, a surface protective layer, a back layer, a back surface protective layer, an antihalation layer and a filter layer. Other matters used herein, such as an emulsion sensitization method and various kinds of additives, are not particularly limited, and for example, those described in JP-A No. 2-68539 may be preferably used.

(15) Surface Protective Layer and Back Surface Protective Layer

The surface protective layer and the back surface protective layer in the invention contain various kinds of compounds using a hydrophilic colloid, such as gelatin, as a binder. In the case where the major component of the layer is gelatin, an antiseptic agent is necessary. The layer preferably contains a matting agent, a lubricating agent, a plasticizer, an anti static agent, a surfactant, a film hardener, a thickner, a dye, an electroconductive substance and the like depending on necessity.

(16) Surface Electric Resistance

The silver halide photographic photosensitive material of the present invention may contact various materials on demands. When the silver halide photographic photosensitive material contacts materials the electric potential thereof is different from the electric potential of the silver halide photographic photosensitive material, the film of the present invention is charged with electricity after a certain time passed. Then when the film is peeled, discharge occurs and thus invites defects called static fogging. Therefore, in to prevent such defects, it is preferable to introduce means, for example, forming an electric charge preventing layer, or providing a means for leaking electricity. As an index of tendency of the static fogging, a surface electric resistance is preferably available.

The surface electric resistance of the present invention is preferably from $10^{10}\Omega$ to $10^{15}\Omega$, more preferably from $10^{10.5}\Omega$ to $10^{14.5}\Omega$, and most preferably from $10^{11.0}\Omega$ to $10^{14}\Omega$.

(17) Developing Method

As a developing method for the silver halide photographic photosensitive material of the invention, those described in JP-A No. 2-103037, page 16, right upper column, line 7 to page 19, left lower column, line 15 and JP-A No. 2-115837, page 3, right lower column, line 5 to page 6, right upper column, line 10 can be employed, and in particular, those described in JP-A No. 2000-112078, page 34, left column, line 42 to page 35, left column, line 2 can be employed.

EXAMPLE

The invention will be described in more detail with reference to the following examples, but the invention is not construed as being limited thereto.

Example 1

Gelatin was dissolved in water to form 350 mL of a gelatin solution having a gelatin concentration of 7.06% by weight. Fluorine surfactant (FSA-28 shown above) and non-fluorine surfactant (A-6 shown below) were added to the gelatin solution, and the solution was measured for surface tension in the case where one of the surfactants was solely added and the case where they were mixed. The results are shown in Tables 1 and 2 below. Table 1 shows the results in the case where one of the surfactants was added, and Table 2 shows the results in the case where the mixture was added. It was confirmed from the results that the surface tension could be effectively decreased by the synergistic effect with maintenance of surface property. In particular, it was found that even in the case where the amount of the fluorine surfactant was extremely small, the surface tension could be effectively decreased by using the non-fluorine surfactant A-6 in combination.

Upon allowing the solutions to stand, the solutions containing the fluorine surfactant solely became clouded and formed insoluble matters precipitated. On the other hand, the solution having the mixture of the surfactants shown in Table 2 maintained transparency and formed no precipitate.

TABLE 1

| Addition amount (g) | | Surface tension |
|---|---|---|
| FSA-28 | A-6 | (dyne/cm) |
| 0 | | 38.2 |
| 0.0025 | | 24.8 |
| 0.005 | | 23.2 |
| 0.0075 | | 19.4 |
| 0.02 | | 18.7 |
| 0.04 | | 14.8 |
| 0.06 | | 14.4 |
| | 0 | 38.2 |
| | 0.06 | 33.3 |
| | 0.12 | 31.7 |
| | 0.29 | 29.8 |
| | 0.58 | 30.1 |

TABLE 2

| Addition amount (g) | | Surface tension |
|---|---|---|
| FSA-28 | A-6 | (dyne/cm) |
| 0.0025 | 0.06 | 24.1 |
| 0.0025 | 0.12 | 25.4 |
| 0.0025 | 0.29 | 26.3 |
| 0.0025 | 0.58 | 27 |
| 0.005 | 0.06 | 20.1 |
| 0.005 | 0.12 | 17.6 |
| 0.005 | 0.29 | 23.1 |
| 0.005 | 0.58 | 23.6 |
| 0.0075 | 0.06 | 16.2 |
| 0.0075 | 0.12 | 16.4 |
| 0.0075 | 0.18 | 18.9 |

A solubility test was then carried out when a minute amount of a coating composition for a surface protective layer was added to a developer solution. This was a model experiment for such a phenomenon in that turbidity or a deposit was formed upon subjecting a large amount of photosensitive materials to a developing treatment. As the coating composition for a surface protective layer, that used in Example 3 described later was used.

The formulation of the developer solution was as follows.

Preparation of Concentrated Solutions

Developer Solution

| (Part Liquid A) | |
|---|---|
| Potassium hydroxide | 270 g |
| Potassium sulfite | 1,125 g |
| Sodium carbonate | 450 g |
| Boric acid | 75 g |
| Diethylene glycol | 150 g |
| Diethylenetriamine tetraacetic acid | 30 g |
| 1-(N,N-Diethylamino)ethyl-5-mercaptotetrazole | 1.5 g |
| Hydroquinone | 405 g |
| 4-Hydroxymethyl-4-methyl-1-phenyl-3-pyrazolidone | 30 g |
| Water | 4,500 mL |
| (Part Liquid B) | |
| Tetraethylene glycol | 750 g |
| 3,3'-Dithiobishydrocinnamic acid | 3 g |
| Glacial acetic acid | 7.5 g |
| 5-Nitroindazole | 4.5 g |
| 1-Phenyl-3-pyrazolidone | 67.5 g |
| Add water to fill up to | 1,000 mL |

-continued

| (Part Liquid C) | |
|---|---|
| Glutaraldehyde (50% by weight) | 150 g |
| Potassium bromide | 15 g |
| Potassium disulfite | 120 g |
| Add water to fill up to | 750 mL |

Preparation of Processing Solution

The solutions were mixed, and 300 mL of an aqueous solution containing 54 g of acetic acid and 55.5 g of potassium bromide was added thereto as a starter, so as to prepare a developer solution.

In order to observe the state of the developer solution, a solution obtained by removing gelatin and polymethyl methacrylate (average particle diameter: 3.7 μm) from the surface protective layer was added dropwise to the developer solution.

The coating composition for a surface protective layer was prepared to make a total amount of 350 mL, and visual evaluation was made when 5 mL of the coating composition for a surface protective layer was added dropwise to the 50 mL of the developer solution at 20° C. according to the following grades.

A: No turbidity
B: Slightly turbid
C: Turbid
D: Deposited

The evaluations for the addition amounts (g) are shown in Table 3 below.

TABLE 3

| Addition amount of | Addition amount of A-6 (g) | | | |
|---|---|---|---|---|
| FSA-28 (g) | 0 | 0.06 | 0.12 | 0.58 |
| 0.0013 | C | B | A | A |
| 0.0025 | C | B | A | A |
| 0.005 | C | C | B | A |

It was understood from the results shown in Table 3 that aggregation and sedimentation were prevented by the combination use of the two kinds of surfactants of the invention.

Example 2

1. Production of Sample 1-1. Preparation of Emulsion 4 g of sodium chloride, 4 g of potassium iodide and 20 g of gelatin were added to 1 L of water and maintained at 70° C. in a reaction vessel, to which 400 mL of a silver nitrate aqueous solution (83 g of silver nitrate) and 190 mL of an aqueous solution containing 57 g of potassium bromide were added under stirring by the double jet method over 16 minutes. After adding an aqueous solution containing from 0.1 to 0.85 mole of ammonia, 250 mL of a silver nitrate aqueous solution (123 g of silver nitrate) and 275 mL of an aqueous solution containing 82.5 g of potassium bromide were added by the double jet method over 20 minutes. After subjecting to physical aging at the same temperature for 18 minutes, the solution was neutralized with an acetic acid aqueous solution, and the temperature was lowered to 35° C. to remove soluble salts by the precipitation method. The temperature was then raised to 40° C., and 23.7 mL of 50% by weight of trimethylolpropane, 42 mg of PROXEL, 32.5 g of gelatin and sodium polystyrenesulfonate (average molecular weight: 600,000) as a thickener were added, followed by adjusting to pH 6.6 with sodium hydroxide. The temperature of the emulsion thus prepared was raised to 49° C., 41 mg of 4-hydroxy-6-methyl-1,3,3a, 7-tetrazaindene, 150 mg of the sensitizing dye D-7, 0.93 mg of chlorauric acid and 165 mg of potassium thiocyanate were added, after lapsing 15 minutes 25 mg of 4,7-dithia-1,10-decanediol was added, after further lapsing 10 minutes, 2.6 mg of sodium thiosulfate and 0.9 mg of the selenium sensitizing agent A-1 were added, and then 1.76 g of 4-hydroxy-6-methyl-1,3,3a, 7-tetrazaindene was added, followed by solidifying through rapid cooling. Thus, an emulsion was produced. The crystal habit thereof was a tetradecahedral shape with rounded corners, and the particle size was from 0.45 to 1.14 μm in terms of a sphere equivalent diameter measured with Master Sizer measuring method.

(D-7)

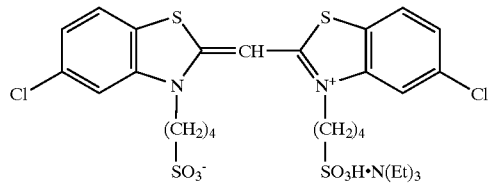

(A-1)

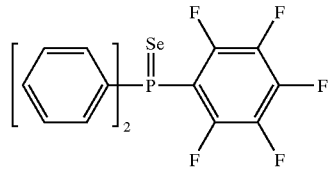

1-2. Preparation and Coating of Emulsion Coating Composition

The following compounds were added to 1 kg of the emulsion (1.52 mole of silver) to form an emulsion coating composition.

| | |
|---|---|
| Gelatin | 38.2 g |
| Sodium polystyrenesulfonate (weight average molecular weight: 600,000) | 1.4 g |
| Polyacrylamide (weight average molecular weight: 45,000) | 27.2 g |
| Compound A-2 | 24.3 mg |
| Compound A-3 | 92.0 mg |
| Compound A-4 | 105.0 mg |
| Compound A-5 | 73.5 mg |
| Palladium chloride | 19.9 μmole |
| 1,3-Dihydroxybenzene | 1.2 g |
| 1,2-bis(vinylsulfonylacetamide)ethane | 1.2 g |
| DV-759L (20% by weight aqueous solution) (Complex latex liquid of an acrylate ester polymer and $SiO_2$, manufactured by Dainippon Ink And Chemicals, Inc.) | 45.0 mL |
| Add water to fill up to | 2,400 mL |

The coating composition was coated on both surfaces of a polyester base having a thickness of 0.18 mm to a silver amount of 2.2 g/m$^2$ per one surface.

A-2

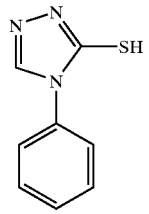

A-3

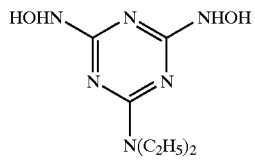

A-4

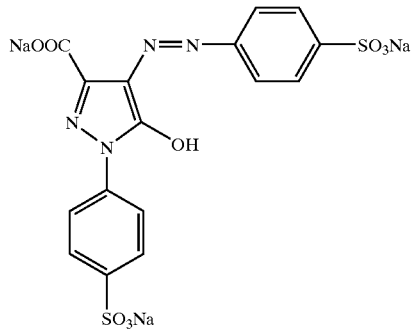

A-5

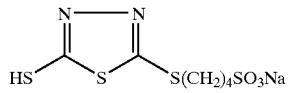

1-3. Preparation and Coating of Coating Composition for Surface Protective Layer Coating compositions for a surface protective layer using surfactants of the invention or for comparison were prepared in the following manner, and were coated on the outer surfaces of the emulsion layers on both surfaces, so as to prepare coated samples. The coating compositions were prepared to make the following coated amounts and then coated.

| | |
|---|---|
| Gelatin | 0.78 g/m$^2$ |
| polymethyl methacrylate (Matting agent, average particle diameter: 3.7 $\mu$m) | 46.7 mg/m$^2$ |
| PROXEL | 0.37 mg/m$^2$ |
| Sodium Polyacrylate (weight average molecular weight: 400,000) | 0.98 mg/m$^2$ |
| Surfactant of the invention, WS-17 or WS-20, or comparative surfactant, A-6 (shown in Table 4) | |
| Surfactant of the invention of FSA-28 or FSA-47, or comparative surfactant of T-1 to T-3 (shown in Table 4) | |
| Compound A-9 | 40.5 mg/m$^2$ |
| Compound A-10 | 2.16 mg/m$^2$ |
| SNOWTEX C (Colloidal silica having particle diameter of about 10 nm, manufactured by Nissan Chemical Industries, Ltd., adjusted to pH 6.9 with sodium hydroxide) | 0.18 g/m$^2$ |
| T-1 | $C_8F_{17}SO_2N(C_3H_7)(CH_2CH_2O)_4(CH_2)_4SO_3Na$ |
| T-2 | $C_8F_{17}SO_2N(C_3H_7)(CH_2CH_2O)_{16}H$ |
| T-3 | $C_8F_{17}SO_3K$ |
| A-6 | |

-continued

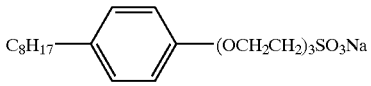

A-9

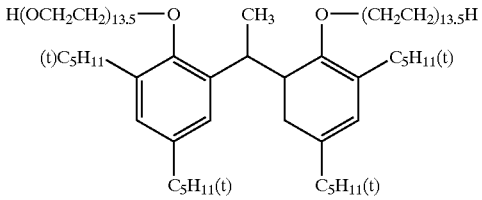

A-10

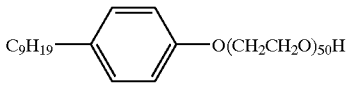

The evaluation results of the resulting samples are shown in Tables 4 and 5 along with the results of Examples 2 to 7. The samples according to the invention showed good property on coated surface (less causing spot failures) and caused less contamination of the processing liquids, to provide practically good results.

Example 3

1. Production of Undercoated Support (1) Preparation of Dye D-1 for Undercoating Layer The following dye was subjected to a dispersion treatment with a ball mill according to the method described in JP-A No. 63-197943.

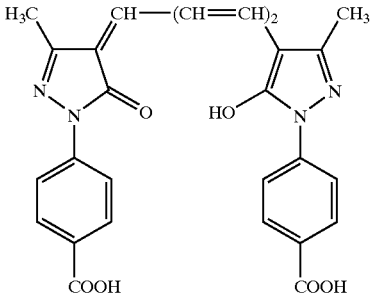

434 mL of water and 791 mL of a 6.7% by weight aqueous solution of Triton® X-200 surfactant (TX-200) were placed in a ball mill. 20 g of the dye was added to the solution. 400 mL of zirconium oxide (ZrO) beads (2 mm in diameter) were added thereto, and the contents were pulverized for 4 days. Thereafter, 160 g of 12.5% by weight gelatin was added. After defoaming, the ZrO beads were removed by filtration. The resulting dye dispersion was observed, and it was found that the dye thus pulverized had a broad distribution in diameter of from 0.05 to 1.15 $\mu$m and an average particle diameter of 0.37 $\mu$m. Dye particles having a diameter of 0.9 $\mu$m or more were removed by centrifugal separation. Thus, a dye dispersion D-1 was obtained.

(2) Preparation of Support

A biaxially stretched polyethylene terephthalate film having a thickness of 183 $\mu$m was subjected to a corona discharge treatment, and a first undercoating composition having the following formulation was coated on one surface thereof with a wire bar coater to a coated amount of 5.1 mL/m$^2$, followed by drying at 175° C. for 1 minute. The same first undercoating layer was provided on the opposite surface. The polyethylene terephthalate used contained 0.04% by weight of a dye having the following structure.

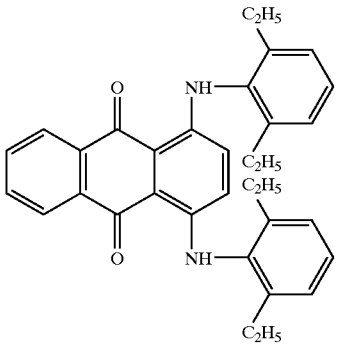

Formulation of First Undercoating Composition

The coated mount per one surface of the support was 4.9 mL, and the coated amounts per 1 m$^2$ Of the respective components added were as follows.

| | |
|---|---|
| Solution of sodium 2,4-dichloro-6-hydroxy-s-triazine (4% by weight) | 8 mg |
| Butadiene-styrene copolymer latex solution | 0.31 g |

(solid content: 40% by weight, butadiene/styrene weight ratio: 31/69, a surfactant having the following structure as an emulsion dispersion was contained in the latex solution in an amount of 0.4% by weight based on the solid content of the latex)

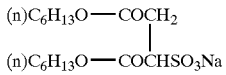

A second undercoating composition having the following formulation was coated on the first undercoating layers on both surfaces of the support one-by-one to make the following coated amounts by a wire bar coating method and dried at 150° C. to form a second undercoating layer.

Formulation of Second Undercoating Layer

The coated mount per one surface of the support was 7.9 mL, and the coated amounts per 1 m$^2$ Of the respective components added were as follows.

| | |
|---|---|
| Gelatin | 81 mg |
| $C_{12}H_{25}O(CH_2CH_2O)_{10}H$ | 3.8 mg |
| Matting agent (Polymethyl methacrylate, average particle diameter: 2.5 μm) | 2.3 mg |
| Polymer latex (Ethyl acrylate/acrylic acid = 95/5 by weight, containing A-9 in an amount of 3% by weight based on the polymer solid content) | 21 mg |
| Dye dispersion D-1 | 8.2 mg |
| Acetic acid | 0.6 mg |

-continued

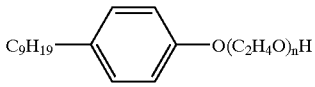

(n=8.5)

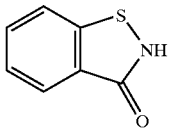

0.27 mg/m$^2$

2. Preparation of Coating Composition (1) Preparation of Silver Halide Emulsion T-1

6 g of potassium bromide and 7 g of gelatin were added to 1 L of water and maintained at 55° C. in a vessel, to which 37 mL of a silver nitrate solution (4.00 g of silver nitrate) and 38 mL of an aqueous solution containing 5.9 g of potassium bromide were added under stirring by the double jet method over 37 seconds. After adding 18.6 g of gelatin, the temperature was raised to 70° C., and 89 mL of a silver nitrate aqueous solution (9.8 g of silver nitrate) was added over 22 minutes. 7 mL of a 25% ammonia aqueous solution was added, and after subjecting to physical aging at the same temperature for 10 minutes, 6.5mL of glacial acetic acid was added. Subsequently, an aqueous solution of 153 g of silver nitrate and an aqueous solution of potassium bromide were added at pAg of 8.5 maintained by the controlled double jet method over 35 minutes. After adjusting the pBr to 2.8 by using a silver nitrate aqueous solution, 15 mL of a 2 mole/L potassium thiocyanate solution was added. After subjecting to physical aging at the same temperature for 5 minutes, the temperature was lowered to 35° C. Thus, a monodisperse pure silver bromide tabular particles having an average projected area diameter of 1.10 μm, a thickness of 0.165 μm and a variation coefficient of diameter of 18.5% were obtained. Thereafter, soluble salts were removed by the precipitation method. The temperature was again raised to 40° C., 30 g of gelatin, 2.35 g of phenoxyethanol and 0.8 g of sodium polystyrenesulfonate as a thickener were added, and pH and pAg were adjusted to 5.90 and 8.25, respectively, with sodium hydroxide and a silver nitrate solution. The emulsion was subjected to chemical sensitization under stirring at a temperature of 56° C. maintained. 0.05% by mole of AgI fine particles were added before and during the chemical sensitization, respectively, per mole of the monodisperse pure silver bromide tabular particles. 0.043 mg of thiourea dioxide was added and maintained intact for 22 minutes to carry out reduction sensitization. 20 mg of 4-hydroxy-6-methyl-1,3,3a,7-tetrazaindene and 400 mg of the sensitizing dye A were added. 0.83 g of calcium chloride was further added. Subsequently, 1.5 mg of sodium thiosulfate, 2.2 mg of the selenium sensitizing agent A-1, 2.6 mg of chlorauric acid and 90 mg of potassium thiocyanate were added as sensitizers, and after lapsing 40 minutes, the temperature was lowered to 35° C. Thus, a tabular silver halide emulsion T-1 was prepared. The amount of iodine contained in the resulting silver halide emulsion T-1 was 0.1% by mole in average.

(2) Preparation of Silver Halide Emulsion T-2

A silver halide emulsion T-2 was prepared in the same manner as in the silver halide emulsion T-1 except that the addition amount of the AgI fine particles was changed to 0.5% by mole before and during the chemical sensitization, respectively.

The amount of iodine contained in the resulting silver halide emulsion T-2 was 1.0% by mole in average.

Sensitizing Dye A

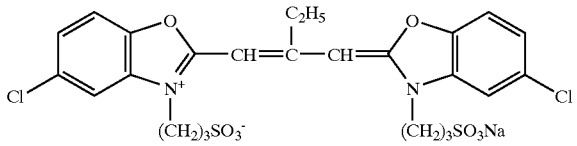

(3) Preparation of Coated Sample

Preparation of Coating Composition for Emulsion Layer

The following compounds were added in the following amounts per mole of silver of the silver halide emulsions (T-1 and T-2) to prepare coating compositions for an emulsion layer.

| | |
|---|---|
| Gelatin (including gelatin in emulsion) | 65.6 g |
| Trimethylolpropane | 9 g |
| Dextran (average molecular weight: 39,000) | 18.5 g |
| Sodium polystyrenesulfonate (average molecular weight: 600,000) | 1.8 g |
| Film hardener (1,2-bis(vinylsulfonylacetamide)ethane (addition amount adjusted to make swelling ratio of 230%) | |
| 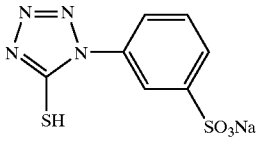 | 34 mg |
| 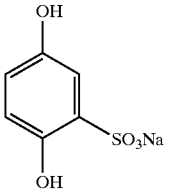 | 4.8 g |

Preparation of Coating Composition for Surface Protective Layer

Coating compositions for a surface protective layer using surfactants of the invention and for comparison were prepared in the following manner and coated. The formulation of the coating composition for surface protective layer was as follows. The numerals indicate coated amounts.

| | |
|---|---|
| Gelatin | 0.966 g/m$^2$ |
| Sodium polyacrylic acid (average molecular weight: 400,000) | 0.023 g/m$^2$ |
| 4-Hydroxymethyl-1,3,3a,7-tetrazaindene | 0.015 g/m$^2$ |
| Polymethyl methacrylate (average particle diameter: 3.7 $\mu$m) | 0.087 g/m$^2$ |
| PROXEL (adjusted to pH 7.4 with NaOH) | 0.0005 g/m$^2$ |

Auxiliary Surfactant (Surfactant of the Invention of WS-17 or WS-20, or Comparative Surfactant A-6, Shown in Table 4) Surfactant of the Invention of FSA-28 or FSA-47, or Comparative Surfactant T-1 to T-3, Shown in Table 4)

Following surfactants

| | |
|---|---|
| $C_{16}H_{33}O(C_2H_4O)_{10}H$ | 0.045 g/m$^2$ |
| $C_{17}H_{35}CONCH_2SO_3Na$ (CH$_3$) | 0.0065 g/m$^2$ |
| 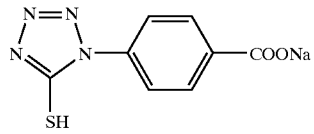 | 1.7 mg/m$^2$ |

3. Coating

The coating composition for an emulsion layer and the coating composition for a surface protective layer were coated on both surfaces of the undercoated support prepared in the foregoing by the simultaneous extrusion method to a coated silver amount of 1.75 g/m$^2$ per one surface.

4. Evaluation of Samples

The samples were evaluated in the same manner as in Example 2. It was found from the results shown in Tables 4 and 5 that the samples according to the invention showed good property on coated surface (less causing spot failures) and causes less contamination of the processing liquids, to provide practically good results.

Example 4

1. Preparation of Silver Halide Emulsion 21 g of gelatin, 10.7 g of $NH_4NO_3$, 0.3 g of KBr and 0.07 g of $AgNO_3$ were added to 1 L of water and maintained at 42° C. in a reaction vessel, to which an aqueous solution containing 85.7 g of $AgNO_3$ and 0.71 g of $NH_4NO_3$ and an aqueous solution containing KBr were added by the controlled double jet method over 19 minutes and 10 seconds. After starting the double jet addition, 2.4 mL of a 25% by weight aqueous ammonia was added, and after lapsing t minutes, it was neutralized with 0.71 g of glacial acetic acid. The aqueous solution containing 85.7 g of $AgNO_3$ and 0.71 g of $NH_4NO_3$ and an aqueous solution containing 39.6 g of KBr, 1.17 g of KI and 0.52 mg of $K_3IrCl_6$ were added to each other by the double jet method over 8 minutes and 40 seconds. The period t was adjusted to make a particle diameter in this stage being 0.21 $\mu$m. Thereafter, the temperature was lowered to 35° C., and soluble salts were removed by the precipitation method. The temperature was then raised to 60° C., and 156 g of gelatin and 5 g of 2-phenoxyethanol were added, followed by adjusting the pH to 6.70 with NaOH and sulfuric acid. Thereafter, 56 mg of 1-phenyl-5-mercaptotetrazole, 4.79 mg of sodium thiosulfate, 124 mg of 4,7-dithia-1,10-decanediol, 49.57 mg of HAuCl and 43.4 mg of potassium thiocyanate were added, and after T minutes, 0.91 g of 4-hydroxy-6-methyl-1,3,3a,7-tetrazaindene was added, followed by rapid cooling and solidification, to form a stock emulsion. The crystal habit of the particles was a cubic shape, and the particle size was 0.21 $\mu$m in terms of a sphere equivalent diameter.

2. Preparation of Emulsion Coating Composition 0.2 g of 2,4-dihydroxybenzaldehydeoxime, 0.66 g of KBr, 3.26 g of sodium p-toluenesulfinate, 0.10 g of sodium 3-(5-mercapto-1-tetrazoyl)benzenesulfonate, 28 mg of lipoic acid, 0.8 g of 1,3-dihydroxybenzene, 82 mg of 3,4-dimethylthiazolin-2-thione, 21 mg of the compound I, 6.4 mg of the compound J and 0.60 g of 2,4-dichloro-6-hydroxy-1,3,5-triazine sodium salt were added to 1 kg of the stock emulsion, and water was then added to make 1,043 mL.

Compound I

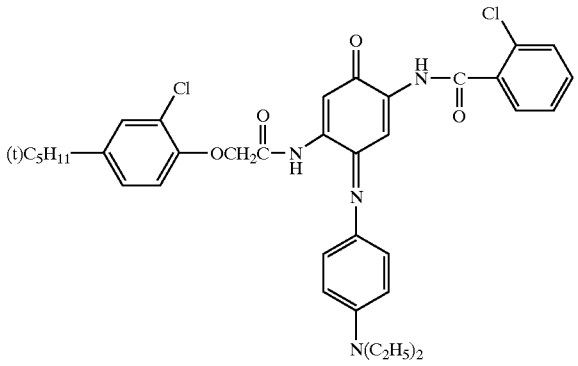

Compound J

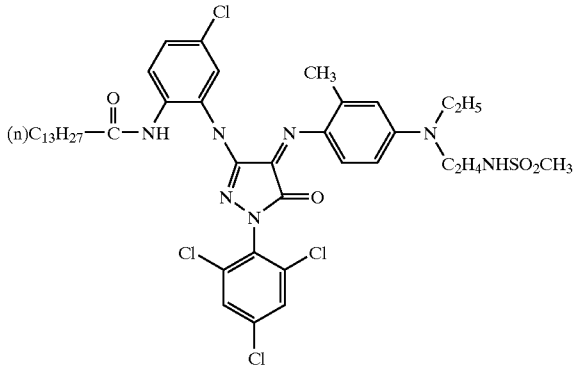

3. Preparation of Coating Composition for Protective Layer 9,865 mL of water, 921 mL of methanol, the surfactant of the invention WS-17 or WS-20, or the comparative surfactant A-6 (shown in Table 4), 28.8 g of a PMMA matting agent having a particle diameter of 5.5 $\mu$m, 4.5 g of the compound A-9 and the surfactant of the invention FSA-28 or the comparative surfactant T-1 or T-2 (shown in Table 4) were added to 1 kg of lime-treated gelatin (pH 6.0, jelly strength: 260 g, Ca content: 2,700 ppm) produced from beef bones, and the pH was adjusted to 5.1 with phosphoric acid. Thereafter, 209 g in terms of solid content of acrylate/methacrylate copolymer (VONCOAT® DV-759, manufactured by Dainippon Ink And Chemicals, Inc.), and 3.56 g of 2,4-dichloro-6-hydroxy-1,3,5-triazine sodium salt were added.

4. Preparation of Coated Sample

The emulsion coating composition and the coating composition for a protective layer were coated on both surfaces of the same support as in Example 3, whereby the coated Ag amount per one surface was 7.35 g/m$^2$, and the coated gelatin amount was 12.0 g/m$^2$ for the emulsion layer and 2.21 g/m$^2$ for the protective layer. In the case where the emulsion layer and the emulsion protective layer were coated on only one surface, the following layer was coated on the surface, on which no emulsion was coated.

5. Evaluation of Samples

The samples were evaluated in the same manner as in Example 2. It was found from the results shown in Tables 4 and 5 that the samples according to the invention showed good property on coated surface (less causing spot failures) and causes less contamination of the processing liquids, to provide practically good results.

6. Production and Evaluation of Additional Samples

Samples of photosensitive materials having an emulsion layer on only one surface were produced according to the same manner as in the foregoing, and were evaluated in the same manner. The emulsion coating composition and the coating composition for a protective layer were coated on only one surface of the support, and a coating composition for a back layer and a coating composition for a back protective layer (BPC) were coated on the back surface.

The samples according to the invention provided good results as similar to Example 4.

(1) Preparation of Coating Composition for Back Layer 1 g of PROXEL (manufactured by ICI, Inc.) 3.5 g of 2,4-dichloro-6-hydroxy-1,3,5-triazine sodium salt, from 0 to 1,514 mL of colloidal silica (trade name: SNOWTEX C, manufactured by Nissan Chemical Industries, Ltd., 20% by weight solution, particle diameter: 10 nm) and from 0 to 1,500 mL of a polymer latex (poly(ethyl acrylate/methacrylic acid)=97/3) were added to 1 kg of the same kind of gelatin as used in the protective layer of Example 4, and water was added to make 9,730 mL.

(2) Preparation of Coating Composition for BPC Layer

The coating composition for a BPC layer had the same formulation as the protective layer on the emulsion layer side, provided that the matting agent was changed to a PMMA matting agent having a particle diameter of 8 $\mu$m, and 0.6 g/m$^2$ in terms of solid content of colloidal silica (SNOWTEX C as shown above) was added.

(3) Coating of Back Layer and BPC Layer

The back layer and the BPC layer were coated by the simultaneous multilayer coating method to a gelatin coated amount of 11 g/m$^2$ for the back layer and 1.7 g/m$^2$ for the BPC layer.

Example 5

1. Preparation of Emulsions (1) Preparation of Silver Bromoiodide Emulsion (O)

39 g of gelatin was dissolved in 1 L of $H_2O$ and placed in a vessel maintained at 65° C., to which 6.4 mg of sodium thiosulfate, 1.3 g of acetic acid, 1.4 g of ammonium hydroxide, 15 mg of silver nitrate, 61 mg of potassium bromide and 3.8 g of the following compound A were added, and then 560 mL of an aqueous solution containing 192 g of silver nitrate and 0.77 g of ammonium nitrate and 470 mL of an aqueous solution containing potassium hexachloroiridate(III) in such an amount that provided a final molar ratio of iridium and silver halide of $2.3\times10^{-7}$ and 130 g of potassium bromide were added by the double jet method. Thereafter, 0.11 g of potassium iodide was added to prepare cubic monodisperse silver bromoiodide particles having an average size of 0.51 $\mu$m. The following compound B was added to the emulsion thus obtained, and after subjecting a desalination treatment, 48 g of gelatin, 0.45 g of sodium polystyrenesulfonate and 2.8 g of phenoxyethanol were added. The pH was adjusted to 6.2, and 1.4 mg of sodium thiosulfate and 3.9 mg of chlorauric acid were added to carry out chemical sensitization at 62° C. Thereafter, 0.38 g of 4-hydroxy-6-methyl-1,3,3a,7-tetrazaindene was added, followed by rapid cooling and solidification.

Compound A

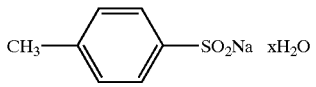

-continued

Compound B

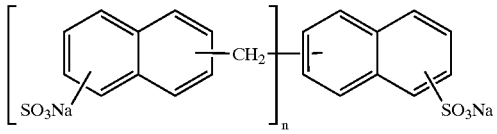

(2) Preparation of Silver Bromoiodide Emulsion (P)

38 g of gelatin was dissolved in 1 L of $H_2O$ and placed in a vessel maintained at 55° C., to which 6.4 mg of sodium thiosulfate, 1.3 g of acetic acid, 0.80 of ammonium hydroxide, 6.1 mg of silver nitrate, 61 mg of potassium bromide and 3.8 g of the compound A were added, and then 590 mL of an aqueous solution containing 190 g of silver nitrate and 0.77 g of ammonium nitrate and 450 mL of an aqueous solution containing potassium hexachloroiridate (III) in such an amount that provided a final molar ratio of iridium and silver halide of $9.0\times10^{-7}$ and 130 g of potassium bromide were added by the double jet method. Thereafter, 0.14 g of potassium iodide was added to prepare cubic monodisperse silver bromoiodide particles having an average size of 0.36 μm. Polyethylene sodium sulfonate (Mw: 50,000) was added to the emulsion thus obtained, and after subjecting a desalination treatment, 48 g of gelatin, 0.14 g of a nucleic acid base mixture, 0.16 g of potassium bromide and 2.2 g of phenoxyethanol were added. The pH was adjusted to 6.0, and 4.1 mg of sodium thiosulfate and 7.4 mg of chlorauric acid were added to carry out chemical sensitization at 60° C. Thereafter, 0.37 g of 4-hydroxy-6-methyl-1,3,3a,7-tetrazaindene was added, followed by rapid cooling and solidification.

2. Preparation of Emulsion Coating Composition

Emulsions O and P were mixed at a molar ratio of 1/2.1, to which the following additives were added per mole of silver halide in the emulsion.

| | | |
|---|---|---|
| (a) | Spectral sensitizing dye D-1 | $3.6 \times 10^{-5}$ mole |
| (b) | Chromatic sensitizing dye (Compound D shown below) | $1.5 \times 10^{-4}$ mole |
| (c) | 3-Allyl-2,6-dimethylbenzothiazolium bromide | $5.7 \times 10^{-4}$ mole |
| (d) | Compound E (shown below) | $2.5 \times 10^{-4}$ mole |
| (e) | Polyacrylamide (molecular weight: 40,000 to 50,000) | 9.3 g |
| (f) | Sodium polystyrenesulfonate | 0.85 g |
| (g) | Latex of poly(ethyl acrylate/methacrylic acid) | 26 g |
| (h) | 1,2-Bis(vinylsulfonylacetamide)ethane | 1.8 g |
| (i) | 1,3-Bis(vinylsulfonylacetamide)propane | 0.59 g |

Spectral sensitizing dye D-1

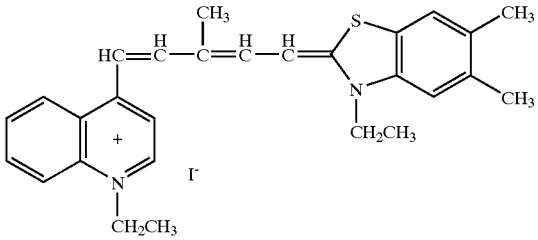

Compound D

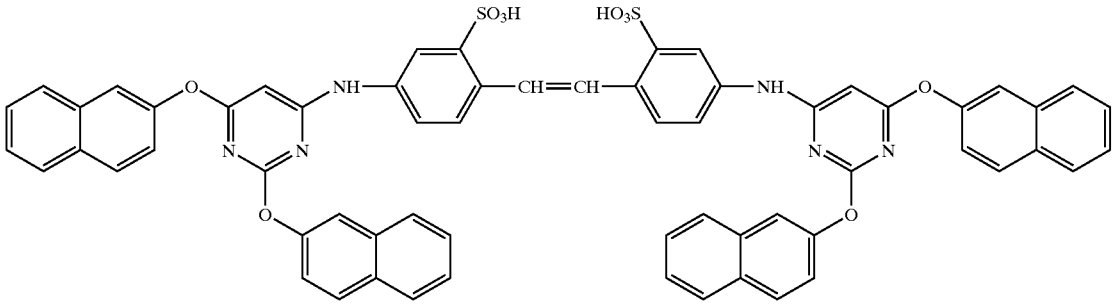

Compound E

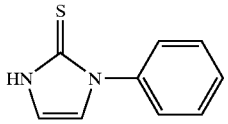

3. Preparation of Coating Composition for Protective Layer on Emulsion Surface

A vessel was heated to 65° C., and additives of the following formulation were placed therein to prepare a coating composition for a protective layer on the emulsion surface.

Formulation of Coating Composition for Protective Layer on Emulsion Surface

| | | |
|---|---|---|
| (a) | Gelatin | 100 g |
| (b) | Polyacrylamide (molecular weight: 40,000 to 50,000) | 12 g |
| (c) | Sodium polystyrenesulfonate | 0.15 g |
| (d) | 1,2-Bis(vinylsulfonylacetamide)ethane | 1.4 g |
| (e) | 1,3-Bis(vinylsulfonylacetamide)propane | 0.46 g |
| (f) | Polymethyl methacrylate fine particles (average particle size: 2.8 μm) | 2.6 g |

-continued

| | | |
|---|---|---|
| (g) | Polymethyl methacrylate fine particles (average particle size: 0.7 μm) | 3.0 g |
| (h) | Surfactant of the invention WS-17 or WS-20, or comparative surfactant A-6 (shown in Table 4) | |
| (i) | $C_{16}H_{33}O—(CH_2CH_2O)_{10}H$ | 3.3 g |
| (j) | Sodium polyacrylate (molecular weight: about 100,000) | 3.7 g |
| (k) | Surfactant of the invention FSA-28, or comparative surfactant T-1 or T-3 (shown in Table 4) | |
| (l) | NaOH (1N) | 3 mL |
| (m) | Methanol | 78 mL |
| (n) | Compound G (shown below) | 52 mg |

Compound G

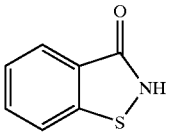

4. Preparation of Coating Composition for Back Layer

A vessel was heated to 65° C., and additives of the following formulation were placed therein to prepare a coating composition for a back layer.

Formulation of Coating Composition for Back Layer

| | | |
|---|---|---|
| (a) | Gelatin | 100 g |
| (b) | Antihalation dye Compound H (shown below) | 2.3 g |
| (c) | Sodium polystyrenesulfonate | 1.7 g |
| (d) | Latex of poly(ethyl acrylate/methacrylic acid) | 3.3 g |
| (e) | 1,2-Bis(vinylsulfonylacetamide)ethane | 2.5 g |
| (f) | 1,3-Bis(vinylsulfonylacetamide)propane | 0.84 g |
| (g) | Compound G (shown below) | 45 mg |
| (h) | Dye Compound I (shown above) | 0.28 g |
| (i) | Dye Compound J (shown above) | 84 mg |
| (j) | Phosphoric acid | 0.40 g |

Compound H

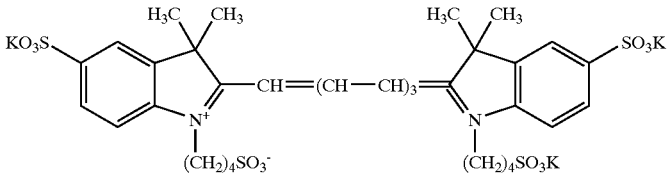

5. Preparation of Coating Composition for Protective Layer on Back Surface

A vessel was heated to 65° C., and additives of the following formulation were placed therein to prepare a coating composition for a protective layer on a back layer.

Formulation of Coating Composition for Protective Layer on Back Surface

| | | |
|---|---|---|
| (a) | Gelatin | 100 g |
| (b) | Sodium polystyrenesulfonate | 0.3 g |
| (c) | 1,2-Bis(vinylsulfonylacetamide)ethane | 1.3 g |
| (d) | 1,3-Bis(vinylsulfonylacetamide)propane | 0.43 g |
| (e) | Polymethyl methacrylate fine particles (average particle size: 5.8 μm) | 3.3 g |
| (f) | Surfactant of the invention WS-17 or WS-20, or comparative surfactant A-6 (shown in Table 4) | |
| (g) | $C_{16}H_{33}O—(CH_2CH_2O)_{10}H$ | 2.9 g |

-continued

| | | |
|---|---|---|
| (h) | Sodium polyacrylate (molecular weight: about 100,000) | 1.3 g |
| (i) | Surfactant of the invention FSA-28 or FSA-47, or comparative surfactant T-1, T-2 or T-3 (shown in Table 4) | |
| (j) | NaOH (1N) | 7 mL |
| (k) | Methanol | 110 mL |
| (l) | Compound G (shown above) | 45 mg |

6. Production of Photographic Material

The coating composition for a back layer and the coating composition for a protective layer on aback surface were coated on one surface of a polyethylene terephthalate support to make a gelatin coated amount of 2.4 g/m$^2$ for the back layer, a gelatin coated amount of 1.4 g/m$_2$ for the back protective layer, and a total gelatin coated amount of 3.8 g/m$^2$. Subsequently, the emulsion coating composition and the coating composition for the surface protective layer were coated on the opposite surface of the support to make a silver amount of the emulsion of 2.8 g/m$^2$ and a gelatin coated amount of 1.2 g/m$^2$ for the surface protective layer.

7. Evaluation of Samples

The samples were evaluated in the same manner as in Example 2. It was found from the results shown in Tables 4 and 5 that the samples according to the invention showed good property on coated surface (less causing spot failures) and causes less contamination of the processing liquids, to provide practically good results.

Example 6

1. Preparation of Emulsions (1) Preparation of Silver Bromoiodide Emulsion (O)

39 g of gelatin was dissolved in 1 L of $H_2O$ and placed in a vessel maintained at 65° C., to which 6.4 mg of sodium thiosulfate, 1.3 g of acetic acid, 1.8 g of ammonium hydroxide, 15 mg of silver nitrate, 61 mg of potassium bromide and 3.8 g of the compound A were added, and then 560 mL of an aqueous solution containing 192 g of silver nitrate and 0.77 g of ammonium nitrate and 470 mL of an aqueous solution containing potassium hexachloroiridate (III) in such an amount that provided a final molar ratio of iridium and silver halide of $2.3\times10^{-7}$ and 130g of potassium bromide were added by the double jet method. Thereafter, 0.11 g of potassium iodide was added to prepare cubic monodisperse silver bromoiodide particles having an average size of 0.51 μm. The compound B was added to the emulsion thus obtained, and after subjecting a desalination treatment, 68 g of gelatin, 0.45 g of sodium polystyrenesulfonate and 2.8 g of phenoxyethanol were added. The pH was adjusted to 6.2, and 1.1 mg of sodium thiosulfate and 3.1 mg of chlorauric acid were added to carry out chemical sensitization at 62° C. Thereafter, 0.37 g of 4-hydroxy-6-methyl-1,3,3a,7-tetrazaindene was added, followed by rapid cooling and solidification.

(2) Preparation of Silver Bromoiodide Emulsion (P)

38 g of gelatin was dissolved in 1 L of $H_2O$ and placed in a vessel maintained at 55° C., to which 6.4 mg of sodium thiosulfate, 1.3 g of acetic acid, 0.80 g of ammonium hydroxide, 6.1 mg of silver nitrate, 61 mg of potassium bromide and 3.8 g of the compound A were added, and then 590 mL of an aqueous solution containing 190 g of silver nitrate and 0.77 g of ammonium nitrate and 450 mL of an aqueous solution containing potassium hexachloroiridate (III) in such an amount that provided a final molar ratio of iridium and silver halide of $9.0\times10^{-7}$ and 130 g of potassium bromide were added by the double jet method. Thereafter, 0.21 g of potassium iodide was added to prepare cubic monodisperse silver bromoiodide particles having an average size of 0.36 μm. The compound C was added to the emulsion thus obtained, and after subjecting a desalination treatment, 75 g of gelatin, 0.16 g of potassium bromide and 2.2 g of phenoxyethanol were added. The pH was adjusted to 6.0, and 7.0 mg of sodium thiosulfate and 9.7 mg of chlorauric acid were added to carry out chemical sensitization at 60° C. Thereafter, 0.37 g of 4-hydroxy-6-methyl-1,3,3a,7-tetrazaindene was added, followed by rapid cooling and solidification.

2. Preparation of Emulsion Coating Composition

Emulsions O and P were mixed at a molar ratio of 1/2.1, to which the following additives were added per one mol of the silver halide in the emulsions to give a coating composition.

| | | |
|---|---|---|
| (a) | Spectral sensitizing dye Compound K-1 | 0.075 g |
| (b) | Spectral sensitizing dye Compound K-2 | 0.140 g |
| (c) | Polyacrylamide (molecular weight: 40,000 to 50,000) | 10.6 g |
| (d) | 1-Phenyl-1,5-mercaptotetrazole | 0.040 g |
| (e) | Compound K-3 | 0.114 g |
| (f) | Compound K-4 | 1.76 g |
| (g) | Compound K-5 | 0.72 g |
| (h) | Latex of poly(ethyl acrylate/methacrylic acid) | 30 g |
| (h) | 1,2-Bis(vinylsulfonylacetamide)ethane | 1.4 g |
| (i) | 1,3-Bis(vinylsulfonylacetamide)propane | 0.47 g |

K-1

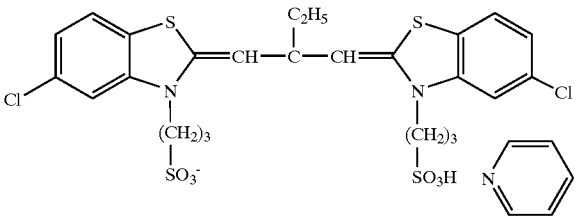

-continued

K-2

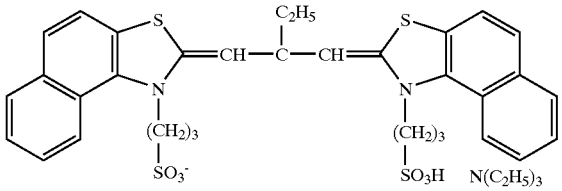

K-3

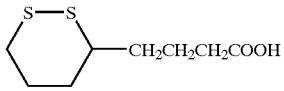

K-4

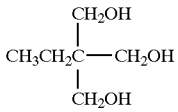

K-5

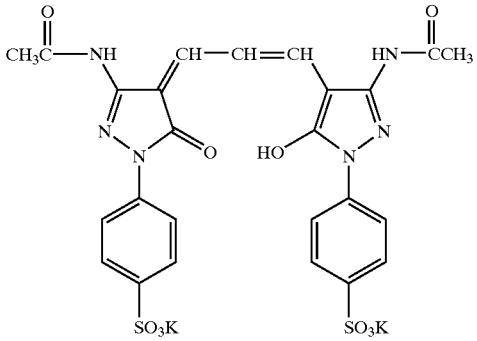

3. Preparation of Coating Composition for Protective Layer on Emulsion Surface

A vessel was heated to 65° C., and additives of the following formulation were placed therein to prepare a coating composition for a protective layer on the emulsion surface.

Formulation of Coating Composition for Protective Layer on Emulsion Surface

| | | |
|---|---|---|
| (a) | Gelatin | 100 g |
| (b) | Polyacrylamide (molecular weight: 40,000 to 50,000) | 11 g |
| (c) | Sodium polystyrenesulfonate | 3 g |
| (d) | 1,2-Bis(vinylsulfonylacetamide)ethane | 1.4 g |
| (e) | 1,3-Bis(vinylsulfonylacetamide)propane | 0.46 g |
| (f) | Polymethyl methacrylate fine particles (average particle size: 2.8 μm) | 2.7 g |
| (g) | Surfactant of the invention WS-17 or WS-20, or comparative surfactant A-6 (shown in Table 4) | |
| (h) | $C_{16}H_{33}O(CH_2CH_2O)_{10}H$ | 3.8 g |
| (i) | Surfactant of the invention FSA-28 or FSA-47, or comparative surfactant T-1, T-2 or T-3 (shown in Table 4) | |
| (j) | NaOH (1N) | 3 mL |
| (k) | Methanol | 71 mL |
| (l) | Compound G (shown above) | 58 mg |

4. Preparation of Coating Composition for Back Layer

A vessel was heated to 65° C., and additives of the following formulation were placed therein to prepare a coating composition for a back layer.

Formulation of Coating Composition for Back Layer

| | | |
|---|---|---|
| (a) | Gelatin | 100 g |
| (b) | Antihalation dye Compound K-6 (shown below) | 2.2 g |
| (c) | Sodium polystyrenesulfonate | 1.4 g |
| (d) | Latex of poly(ethyl acrylate/methacrylic acid) | 2.6 g |
| (e) | 1,2-Bis(vinylsulfonylacetamide)ethane | 2.3 g |
| (f) | 1,3-Bis(vinylsulfonylacetamide)propane | 0.7 g |
| (g) | Compound G (shown above) | 61 mg |
| (h) | Dye Compound I (shown above) | 0.27 g |
| (i) | Dye Compound J (shown above) | 50 mg |
| (j) | Phosphoric acid | 0.81 g |
| (k) | Dye Compound K-6 (shown below) | 2.2 g |
| (l) | Methanol | 59 mL |

K-6

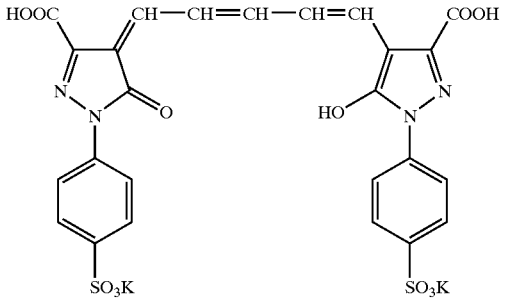

5. Preparation of Coating Composition for Protective Layer on Back Surface

A vessel was heated to 65° C., and additives of the following formulation were placed therein to prepare a coating composition for a protective layer on a back layer.

Formulation of Coating Composition for Protective Layer on Back Surface

| | | |
|---|---|---|
| (a) | Gelatin | 100 g |
| (b) | Sodium polystyrenesulfonate | 0.3 g |
| (c) | 1,2-Bis(vinylsulfonylacetamide)ethane | 1.5 g |
| (d) | 1,3-Bis(vinylsulfonylacetamide)propane | 0.48 g |
| (e) | Polymethyl methacrylate fine particles (average particle size: 4.7 $\mu$m) | 3.3 g |
| (f) | Compound A-6 | 2.1 g |
| (g) | $C_{16}H_{33}O—(CH_2CH_2O)_{10}H$ | 3.7 g |
| (h) | Sodium polyacrylate III-2 (molecular weight: about 100,000) | 1.9 g |
| (i) | Surfactant of the invention FSA-28 or FSA-47, or comparative surfactant T-1, T-2 or T-3 (shown in Table 4) | |
| (j) | NaOH (1N) | 6 mL |
| (k) | Methanol | 101 mL |
| (l) | Compound G (shown above) | 45 mg |

6. Production of Photographic Material

The coating composition for a back layer and the coating composition for a protective layer on a back surface were coated on one surface of a polyethylene terephthalate support to make a gelatin coated amount of 3.0 gm$^2$for the back layer, a gelatin coated amount of 1.5 g/m$^2$ for the back protective layer, and a total gelatin coated amount of 4.5 g/m$^2$. Subsequently, the emulsion coating composition and the coating composition for the surface protective layer were coated on the opposite surface of the support to make a silver amount of the emulsion of 2.9 g/m$^2$ and a gelatin coated amount of 1.2 g/m$^2$ for the surface protective layer.

7. Evaluation of Samples

The samples were evaluated in the same manner as in Example 2. It was found from the results shown in Tables 4 and 5 that the samples according to the invention showed good property on coated surface (less causing spot failures) and causes less contamination of the processing liquids, to provide practically good results.

Example 7

1. Preparation of Emulsion A 2.4 g of potassium rhodanate, 10 mg of sodium thiosulfate pentahydrate and 10 mL of glacial acetic acid were added to 1 L of a solution containing 5.0 g of potassium bromide, 4.0 g of sodium p-toluenesulfonate and 20 g of gelatin, and the solution was maintained at 70° C. under vigorous stirring, to which 308 mL of an aqueous solution containing 117 g of silver nitrate and 305 mL of an aqueous solution containing 82.4 g of potassium bromide were added by the double jet method at a constant rate in twice over 30 second for the first addition and over 15 minutes for the second addition. 2.1 g of potassium iodide was added between the first addition and the second addition. Thereafter, 7.8 mL of 25% by weight aqueous ammonia was added, and after subjecting to aging for 10 minutes, 224 mL of an aqueous solution containing 83.3 g of silver nitrate and 209 mL of an aqueous solution containing 52.5 g of potassium bromide and 3.3 g of potassium iodide were added by the double jet method at a constant rate.

The resulting reaction solution was washed by the ordinary flocculation method, and 101 g of gelatin, 0.9 g of sodium polystyrenesulfonate (average molecular weight: 600,000), 6.5 g of the compound K-4 (shown above) and 2.8 g of phenoxyethanol were added and dispersed, followed by adjusting pH to 6.5. Under maintaining the reaction solution at 57° C., 220 mg of 4-hydroxy-6-methyl-1,3,3a,7-tetrazaindene was added, and the solution was aged for 5 minutes. 270 mg of the sensitizing dye A was added, and the solution was aged for 10 minutes. 9 mg of sodium thiosulfate pentahydrate, 2.1 mg of chlorauric acid, 54 mg of potassium rhodanate and 51 mg of potassium iodide were sequentially added, and the solution was aged for 74 minutes. Thereafter, 730 mg of 4-hydroxy-6-methyl-1,3,3a,7-tetrazaindene, 78 mg of sodium sulfite and 105 mg of the compound A-5 were added.

Thus, an irregular particle emulsion A was obtained.

2. Preparation of Emulsion B

Under maintaining 1 L of a solution containing 6.9 g of potassium bromide and 8 g of low molecular weight gelatin (average molecular weight: 20,000 or less) at 55° C., 36 mL of an aqueous solution containing 4 g of silver nitrate and 39 mL of an aqueous solution containing 5.9 g of potassium bromide were added thereto under vigorous stirring over 37 seconds. Thereafter, 128 mL of a 14.5% by weight gelatin solution was added, and after increasing the temperature from 55° C. to 720° C., 90 mL of an aqueous solution containing 10 g of silver nitrate was added over 21 minutes and 30 seconds. Thereafter, an aqueous solution containing 8.5 mL of a 25% by weight aqueous ammonia, 7.8 mL of glacial acetic acid and 1.0 g of potassium bromide was added, and an aqueous solution containing 145 g of silver nitrate and 432 mL of an aqueous solution containing potassium bromide were added under maintaining pBr at 1.9. The total amount of the silver nitrate aqueous solution was added at an initial rate of 1.9 mL/min over 35 minutes. Thereafter, an aqueous solution containing 6.9 g of potassium rhodanate was added, followed by subjecting to aging for 7 minutes. The resulting reaction solution was washed by the ordinary flocculation method, and 35 g of gelatin, 0.5 g of sodium polystyrenesulfonate (average molecular weight: 600,000) and 1.7 g of the antiseptic agent A were added and dispersed, followed by adjusting pH to 6.1. Under maintaining the reaction solution at 570° C., $3.5\times10^{-5}$ mole/moleAg of the thiosulfonic acid compound T was added, and then AgI fine particles were added in an amount of 0.07% mole based on the total silver amount. 110 mg of 4-hydroxy-6-methyl-1,3,3a,7-tetrazaindene and 450 mg of the sensitizing dye A were added, and then 0.83 g of potassium chloride was added. Thereafter, 1.6 mg of chlorauric acid, 41 mg of potassium rhodanate, 2.2 mg of sodium thiosulfate pentahydrate and 0.9 mg of the selenium sensitizing agent A-1 were sequentially added, followed by subjecting to aging for 23 minutes. 12.3 mg of sodium sulfite was then added, followed by further subjecting to aging for 30 minutes. Thereafter, 51.3 mg of a water soluble mercapto compound B was added.

Thiosulfonic Acid Compound T $C_2H_5$—$SO_2SNa$

Water Soluble Mercapto Compound B

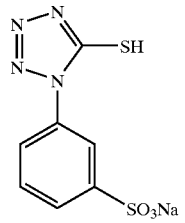

Thus, a monodisperse tabular emulsion B was obtained. The average particle size equivalent to projected area was 1.03 μm, and the aspect ratio was 6.0.

3. Preparation of Coating Composition for Upper Emulsion Layer

The following compounds were added to the emulsion A to prepare a coating composition for an upper emulsion layer.

Coating Composition for Upper Emulsion Layer 1

| | | |
|---|---|---|
| Emulsion A (gelatin: 81 g, Ag: 92 g) | 1 | kg |
| Polyacrylamide (average molecular weight: 40,000 to 50,000) | 19.8 | g |
| Polymer latex (Poly(ethyl acrylate/methacrylic acid) = 97/3 by weight) | 2.9 | g |
| Film hardener (1,2-bis(vinylsulfonylacetamide)ethane) | 1.2 | g |
| 4-Hydroxy-6-methyl-1,3,3a,7-tetrazaindene | 0.20 | g |
| 2,6-Bis(hydroxyamino)-4-diethylamino-1,3,5-triazine | 0.04 | g |
| $C_9H_{19}C_6H_4O(CH_2CH_2O)_{50}H$ | 0.05 | g |
| Add distilled water to fill up to to fill up to | 1,170 | mL |

4. Preparation of Coating Composition for Lower Emulsion Layer

Coating Composition for Lower Emulsion Layer 1

| | | |
|---|---|---|
| Emulsion B (gelatin: 50 g, Ag: 110 g) | 1 | kg |
| Gelatin | 57 | g |
| Polyacrylamide (average molecular weight: 40,000 to 50,000) | 11 | g |
| Polymer latex (Poly(ethyl acrylate/methacrylic acid) = 97/3 by weight) | 4.5 | g |
| Film hardener (1,2-bis(vinylsulfonylacetamide)ethane) | 1.2 | g |
| 2,6-Bis(hydroxyamino)-4-diethylamino-1,3,5-triazine | 0.06 | g |
| Cutback agent A | 0.50 | g |
| Potassium p-hydroquinonesulfonate | 1.0 | g |
| Potassium iodide | 0.09 | g |
| Compound A-2 | 0.05 | g |
| Compound K-4 | 7.3 | g |
| Sodium polystyrenesulfonate (average molecular weight: 600,000) | 1.2 | g |
| Add distilled water to fill up to to fill up to | 1,790 | mL |

Cutback Agent A

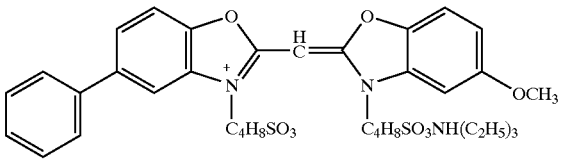

5. Preparation of Coating Composition for Protective Layer

| | | |
|---|---|---|
| Gelatin | 1 | kg |
| $C_{16}H_{33}O(CH_2CH_2O)_{10}H$ | 27 | g |
| Surfactant of the invention FSA-28 or FSA-47, or comparative surfactant T-1, T-2 or T-3 (shown in Table 4) | | |
| Polymethyl methacrylate particles (average particle diameter: 2.5 μm) | 69 | g |
| PROXEL | 0.56 | g |
| Sodium polyacrylate (average molecular weight: 41,000) | 19 | g |
| Sodium polystyrenesulfonate | 10.5 | g |

-continued

| | |
|---|---|
| (average molecular weight: 600,000) | |
| NaOH | 3.2 g |
| Surfactant of the invention WS-17 or WS-20, or comparative surfactant A-6 (shown in Table 4) | |
| Compound A-5 | 5.7 g |
| Metanol | 420 mL |
| Add distilled water to fill up to to fill up to | 18.6 L |

6. Coating Composition for Antihalation Layer (1) Preparation of Dye Dispersion L A solution formed by dissolving 2.5 g of each of Dye-1, Oil-I and Oil-II in 50 cc of ethyl acetate was mixed with 90 g of a 8% by weight gelatin aqueous solution containing 1.5 g of sodium dodecylbenzenesulfonate and 0.18 g of methyl p-hydroxybenzoate at 60° C. and subjected to high speed agitation in a homogenizer. After completing the high speed agitation, it was subjected to a reduced pressure treatment at 60° C. in an evaporator to remove 92% by weight of ethyl acetate. Thus, a dye dispersion L having an average particle diameter of 0.18 μm was obtained.

(2) Preparation of Coating Composition

| | |
|---|---|
| Gelatin | 1 kg |
| Polymer latex (poly(ethyl acrylate/methacrylic acid) = 97/3 by weight) | 135 g |
| Phosphoric acid | 1.23 g |
| Colloidal silica (SNOWTEX C as shown above) | 120 g |
| PROXEL | 0.5 g |
| Dye dispersion L | 271 g |
| Dye 2 | 18.1 g |
| Compound K-6 | 12.7 g |
| Dye 4 | 13 g |
| Film hardener (1,2-bis(vinylsulfonylacetamide)ethane) | 17.5 g |
| Sodium polystyrenesulfonate (average molecular weight: 600,000) | 6 g |
| Add distilled water to fill up to to fill up to | 13.8 L |

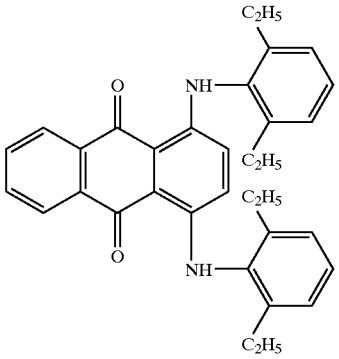

Dye 1

-continued

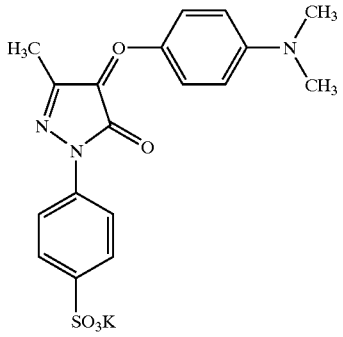

Dye 2

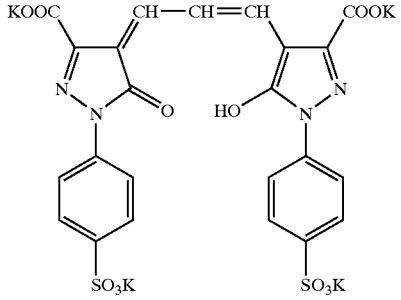

Dye 4

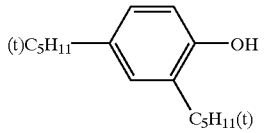

Oil-I

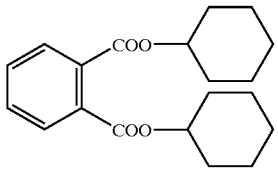

Oil-II

7. Coating Composition for Back Protective Layer

| | |
|---|---|
| Gelatin | 1 kg |
| Compound A-9 | 8.5 g |
| $C_{16}H_{33}O(CH_2CH_2O)_{10}H$ | 33 g |
| Surfactant of the invention FSA-28 or FSA-47, or comparative surfactant T-1, T-2 or T-4 (shown in Table 4) | |
| Polymethyl methacrylate particles (average particle diameter: 3.7 μm) | 34 g |
| PROXEL | 0.5 g |
| Sodium polyacrylate (average molecular weight: 41,000) | 22.8 g |
| NaOH | 2.3 g |
| Surfactant of the invention WS-17 or WS-20, or comparative surfactant A-6 (shown in Table 4) | |
| Add distilled water to fill up to to fill up to | 10.7 L |

T-4 $C_9H_{19}(Ph)O(CH_2)_4SO_3Na$

8. Coating

On one surface of a PET support having a thickness of 175 μm having been undercoated, a protective layer as the outermost layer, and thereunder, an upper emulsion layer of the emulsion A and a lower emulsion layer of the emulsion B were coated by simultaneous extrusion method. The gelatin amount of the protective layer was 0.6 g/m$^2$. The coated layers were then dried to prepare a photosensitive material. The emulsion layers were coated in such a manner that the coated silver amount for the upper emulsion layer was 2.9 g/m$^2$, and the coated silver amount for the lower emulsion layer was 1.5 g/m$^2$. On the opposite surface of the support to the photosensitive layer, an antihalation dye layer and a protective layer were coated to gelatin coated amounts of 3.9 g/m$^2$ and 1.3 g/m$^2$, respectively.

9. Evaluation

The coating composition was evaluated for surface tension and property of coated surface, and contamination of a processing solution upon carrying out development under the following conditions. The results are shown in Tables 4 and 5.

The samples according to the invention showed good property on coated surface (less causing spot failures) and causes less contamination of the processing liquids, to provide practically good results.

Development was carried out by using an automatic developing machine (trade name: CEPROS-M2, manufactured by Fuji Photo Film Co., Ltd.) by using a developer solution (trade name: CED-1, manufactured by Fuji Photo Film) at 34° C. for 25 seconds (total processing time: 90 seconds). As the fixing solution, trade name: CEF-1, manufactured by Fuji Photo Film Co., Ltd.) was used, and water washing was carried out by using tap water.

(i) Spot Failure:

10 m$^2$ of the coated sample was observed with a loupe, and the result was expressed in terms of number of spots.

(ii) Contamination of Processing Solution:

30 m$^2$ per day of the coated sample was subjected to development processing, and after lapsing one week, contamination of the developer solution was observed with the naked eye.

Grade 1: Precipitation of deposits observed

Grade 2: Large number of floating deposits observed

Grade 3: Deposits observed with no practical problem

Grade 4: Slight deposits observed

Grade 5: No deposit observed (iii) Static Test:

A sensitization screen (trade name: Hi-SCREEN B-2, manufactured by Fuji Photo Film Co., Ltd.) was put to an inside of a cassette (trade name: Fuji EC CASSETTEN, manufactured by Fuji Photo Film Co., Ltd.) . The screen was rubbed with fibers under conditions of 25° C. in temperature and 25 % in humidity, then application of a cleaner (trade name: Fuji AS cleaner (for X-ray sensitization screen), manufactured by Fuji Photo Film Co., Ltd.) so that the surface electric resistance of the screen was controlled within a range from 3 to 4 kV. Test samples (namely, comparative examples and samples of the present invention) were set in the cassette. After being left in a dark room of 25° C. in temperature and 25 % in humidity, the tested samples were taken out from the cassette, and developed by using an automatic developing apparatus (trade name: CEPROS-M2, manufactured by Fuji Photo Film Co., Ltd.) with a developing agent (trade name: CED-1, manufactured by Fuji Photo Film Co., Ltd.) at 34° C. for 25 seconds (total processing time: 90 seconds). As the fixing solution, tradename: CEF-1, manufactured by Fuji Photo Film Co., Ltd.) was used, and water washing was carried out by using tap water.

Static was then evaluated for the obtained test samples.

Grading for Static Evaluation:

Grade 1: No static mark observed

Grade 2: Slight static marks observed

Grade 3: Middle size of static marks were observed

Grade 4: Large size of static marks were observed

Grade 5: Extremely large size of static marks were observed

TABLE 4

| | Sample name | Spot failure | Extent of contamination of processing solution | Static |
|---|---|---|---|---|
| Example 2 | comparative example | 13 | 3 | 3 |
| Example 2-1 | present invention | 7 | 4 | 4 |
| Example 2-2 | present invention | 5 | 4 | 5 |
| Example 2-3 | present invention | 6 | 4 | 4 |
| Example 3 | comparative example | 18 | 3 | 4 |
| Example 3-1 | present invention | 8 | 5 | 4 |
| Example 3-2 | present invention | 6 | 4 | 5 |
| Example 3-3 | present invention | 6 | 4 | 5 |
| Example 4 | comparative example | 16 | 3 | 3 |
| Example 4-1 | present invention | 7 | 4 | 4 |
| Example 4-2 | present invention | 8 | 3 | 4 |
| Example 4-5 | present invention | 5 | 4 | 5 |
| Example 5 | comparative example | 14 | 4 | 3 |
| Example 5-1 | present invention | 5 | 4 | 3 |
| Example 5-2 | present invention | 5 | 5 | 5 |
| Example 5-3 | present invention | 4 | 4 | 4 |
| Example 6 | comparative example | 13 | 3 | 3 |
| Example 6-1 | present invention | 6 | 5 | 4 |
| Example 6-2 | present invention | 5 | 5 | 5 |
| Example 6-3 | present invention | 6 | 4 | 4 |
| Example 7 | comparative example | 16 | 4 | 3 |
| Example 7-1 | present invention | 7 | 5 | 4 |
| Example 7-2 | present invention | 8 | 5 | 4 |
| Example 7-3 | present invention | 7 | 4 | 4 |

TABLE 5

| | | Fluorine surfactant (mg per 100 g of gelatin) | | | | | | Non-fluorine surfactant (mg per 100 g of gelatin) | | | | Surface tension | Surface resistance | |
|---|---|---|---|---|---|---|---|---|---|---|---|---|---|---|
| Example No. | Layer | T-1 | T-2 | T-3 | FSA-28 | FSA-47 | Total | A-6 | T-4 | WS-17 | WS-20 | (mN/m) | Log SR | Note |
| Example 2 | EPL* | 228 | 192 | | | | 420 | 0.6 | | | | 28.6 | 13.7 | Comp. ex. |
| Example 2-1 | EPL | | | | 103 | | 103 | 0.6 | | | | 27.4 | 13.5 | Present |
| Example 2-2 | EPL | | | | 103 | | 103 | | | | 0.6 | 28.1 | 13.1 | invention |
| Example 2-3 | EPL | | | | | 103 | 103 | | | 0.6 | | 27.8 | 13.2 | |
| Example 3 | EPL | 186 | 413 | | | | 599 | 2.3 | | | | 27.8 | 12.7 | Comp. ex. |
| Example 3-1 | EPL | | | | 101 | | 101 | 2.3 | | | | 25.5 | 12.6 | Present |
| Example 3-2 | EPL | | | | 101 | | 101 | | | | 2.3 | 26.1 | 12.2 | invention |
| Example 3-3 | EPL | | | | | 101 | 101 | | | | 2.3 | 26 | 12.2 | |
| Example 4 | EPL | 138 | | | | | 138 | 3 | | | | 29.5 | 14.1 | Comp. ex. |
| Example 4-1 | EPL | | | | 40 | | 40 | 3 | | | | 25.2 | 13.9 | Present |
| Example 4-2 | EPL | | | | 40 | | 40 | | | | 3 | 27.2 | 13.3 | invention |
| Example 4-3 | EPL | | | | | 40 | 40 | | | 3 | | 26.8 | 13.5 | |
| Example 5 | EPL | 89 | | 84 | | | 173 | 1.5 | | | | 31.4 | 13.8 | Comp. ex. |
| Example 5 | BPL** | 45 | | 262 | | | 307 | 1.8 | | | | 30.4 | 13.9 | |
| Example 5-1 | EPL | | | | 111 | | 111 | 1.5 | | | | 29.2 | 13.8 | Present |
| Example 5-1 | BPL | | | | 59 | | 307 | 1.8 | | | | 30.1 | 13.8 | invention |
| Example 5-2 | EPL | | | | 111 | | 111 | | | | 1.5 | 29.8 | 13.3 | |
| Example 5-2 | BPL | | | | 59 | | 59 | | | | 1.8 | 30.1 | 13.4 | |
| Example 5-3 | EPL | | | | | 111 | 111 | | | | 1.5 | 29.7 | 13.2 | |
| Example 5-3 | BPL | | | | | 69 | 59 | | | | 1.8 | 30 | 13.2 | |
| Example 6 | EPL | 88 | | 63 | | | 151 | 1.6 | | | | 31 | 13.8 | Comp. ex. |
| Example 6 | BPL | 79 | | 46 | | | 125 | 2.1 | | | | 30.8 | 13.9 | |
| Example 6-1 | EPL | | | | 100 | | 100 | 1.6 | | | | 29.4 | 13.8 | Present |
| Example 6-1 | BPL | | | | 89 | | 89 | 2.1 | | | | 29.8 | 13.8 | invention |
| Example 6-2 | EPL | | | | 100 | | 100 | | | | 1.6 | 29.7 | 13.5 | |
| Example 6-2 | BPL | | | | 89 | | 89 | | | | 2.1 | 30.4 | 13.4 | |
| Example 6-3 | EPL | | | | | 100 | 100 | | | 1.6 | | 30 | 13.5 | |
| Example 6-3 | BPL | | | | | 89 | 89 | | | 2.1 | | 30.2 | 13.3 | |
| Example 7 | EPL | 138 | 96 | | | | 234 | 1.6 | | | | 27.9 | 13.8 | Comp. ex. |
| Example 7 | BPL | | | 212 | | | 212 | | 1 | | | 30.8 | 13.9 | |
| Example 7-1 | EPL | | | | 128 | | 128 | 1.6 | | | | 25.6 | 13.7 | Present |
| Example 7-1 | BPL | | | | 77 | | 77 | | i | | | 29.2 | 13.9 | invention |
| Example 7-2 | EPL | | | | 128 | | 128 | | | | 1.6 | 26 | 13.4 | |
| Example 7-2 | BPL | | | | 77 | | 77 | | | | 1.6 | 29.5 | 13.5 | |
| Example 7-3 | EPL | | | | | 128 | 128 | | | | 1.6 | 26.3 | 13.5 | |
| Example 7-3 | BPL | | | | | 77 | 77 | | | | 1.6 | 29.8 | 13.6 | |

*EPL: Emulsion protective layer
**BPL: Emulsion protective layer

Example 8

Samples were prepared in the same manner as in Example 7 except that FS-1, FS-2, FS -5, FS-14, FSA-19, FSA-27 and FSA-30 were used instead of FSA-28 or FSA-47 in the same amount thereof, and evaluated in the same manner as in Example 1. The resulting samples exhibited good results as similar to the samples according to the invention in Example 7.

Example 9

The same procedures as in Example 7 were repeated except that the following formulations were used for the surface protective layer and the back protective layer with the addition amounts being arbitrarily selected from the following ranges, and the resulting samples exhibited good results as similar to the foregoing.

Formulation of Surface Protective Layer

| | |
|---|---|
| Compound G | 0.2 to 5.0 mg/m$^2$ |
| NaOH | 0.7 to 10 mg/m$^2$ |
| A-6 | 0 to 100 mg/m$^2$ |
| WS-17 | 0 to 100 mg/m$^2$ |
| WS-20 | 0 to 100 mg/m$^2$ |

-continued

| | |
|---|---|
| U-10 | 100 to 400 mg/m$^2$ |
| U-11 | 30 to 300 mg/m$^2$ |
| Dextran | 100 to 500 mg/m$^2$ |
| Sodium polystyrenesulfonate | 0.4 to 40 mg/m$^2$ |
| U-1 | 3.0 to 30 mg/m$^2$ |
| U-3 | 5.0 to 30 mg/m$^2$ |
| U-12 | 25 to 200 mg/m$^2$ |
| U-13 | 10 to 100 mg/m$^2$ |
| A-10 | 0.2 to 5.0 mg/m$^2$ |
| A-9 | 1.0 to 100 mg/m$^2$ |
| P-3 | 6.0 to 120 mg/m$^2$ |
| FSA-28 | 0 to 10 mg/m$^2$ |
| FSA-47 | 0 to 10 mg/m$^2$ |
| U-4 | 0.5 to 10 mg/m$^2$ |
| A-5 | 0.5 to 5.0 mg/m$^2$ |
| U-9 | 1.0 to 20 mg/m$^2$ |
| U-8 | 2.5 to 100 mg/m$^2$ |
| U-5 | 0.2 to 5.0 mg/m$^2$ |
| Sodium acetate | 1.0 to 100 mg/m$^2$ |
| $SiO_2$ | 100 to 800 mg/m$^2$ |
| $KNO_3$ | 30 to 300 mg/m$^2$ |
| $H_3PO_4$ | 7.5 to 75 mg/m$^2$ |

$C_{17}H_{35}CON(CH_3)CH_2CH_2SO_3Na$

U-1

-continued

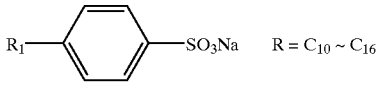

U-2

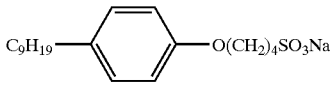

U-3

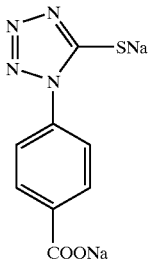

U-4

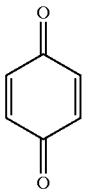

U-5

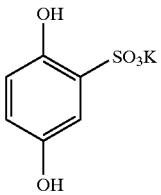

U-6

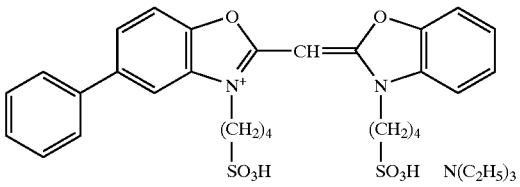

U-7

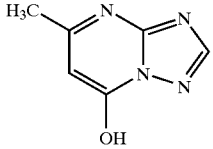

U-8

-continued

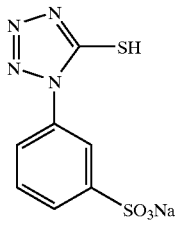

U-9

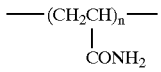

U-10

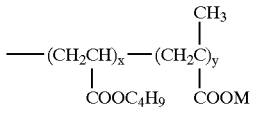

U-11 x:y = 60:40 (wt %)
M = H/Na = 20/80 (mol)

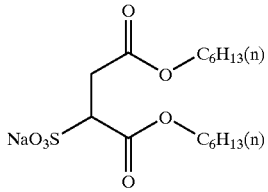

U-12

According to the invention, such a photosensitive material is obtained that is excellent in high-speed coating suitability and has a coated surface in good condition even with an extremely small amount of a fluorine surfactant, and also such a photosensitive material is obtained that causes less contamination of a developer solution even when a large amount of the material is subjected to development process.

What is claimed is:

1. A silver halide photographic photosensitive material comprising a support, a photosensitive silver halide emulsion layer formed on at least one surface of the support, and a surface protective layer formed on the photosensitive silver halide emulsion layer, wherein the silver halide photographic photosensitive material contains at least one compound represented by the following general formula (1) and at least one compound represented by the following general formula (2):

General Formula (1)

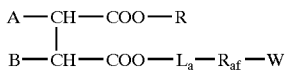

wherein, in general formula (1), R represents an alkyl group substituted with an atom or an atomic group other than fluorine, or an unsubstituted alkyl group; $R_{af}$ represents a perfluoroalkylene group; W represents a hydrogen atom or a fluorine atom; $L_a$ represents an unsubstituted or substituted alkylene group, a substituted or unsubstituted alkyleneoxy group, or a divalent group combining these groups; one of A and B represents a hydrogen atom, and the other represents —$L_b$—$SO_3M$; M represents a cation or a hydrogen atom; and $L_b$ represents a single bond or a substituted or unsubstituted alkylene group:

General Formula (2)

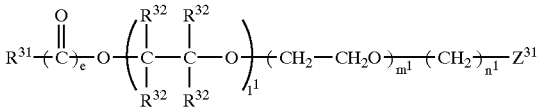

wherein, in general formula (2), $R^{31}$ represents an alkyl group having from 6 to 25 carbon atoms or an alkenyl group having from 6 to 25 carbon atoms; $R^{32}$ may be the same as or different from each other, and each represents a hydrogen atom, an alkyl group having from 1 to 14 carbon atoms, an alkenyl group having from 1 to 14 carbon atoms, an aralkyl group having from 7 to 20 carbon atoms, or an aryl group having from 6 to 18 carbon atoms; $l^1$ represents an integer from 1 to 10; $m^1$ represents an integer from 0 to 30; $n^1$ represents an integer from 0 to 4; e represents 0 or 1; $Z^{31}$ represents $OSO_3M$ or $SO_3M$; and M represents a cation.

2. The silver halide photographic photosensitive material of claim 1, wherein the compound represented by the general formula (1) is a compound represented by the following general formula (3):

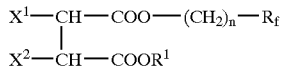

wherein in general formula (3), $R^1$ represents a substituted or unsubstituted alkyl group having a total carbon number of from 6 to 15, provided that $R^1$ does not represents an alkyl group substituted with a fluorine atom; $R_f$ represents a perfluoroalkyl group having from 1 to 6 carbon atoms; one of $X^1$ and $X^2$ represents a hydrogen atom, and the other represents —$L_b$—$SO_3M$; M represents a cation or a hydrogen atom; $L_b$ represents a single bond or a substituted or unsubstituted alkylene group; and n represents an integer from 1 to 8.

3. The silver halide photographic photosensitive material of claim 2, wherein $R_f$ in the general formula (3) is a perfluoroalkyl group having from 2 to 4 carbon atoms.

4. A silver halide photographic photosensitive material comprising a support, a photosensitive silver halide emulsion layer formed on at least one surface of the support, and a surface protective layer formed on the photosensitive silver halide emulsion layer, wherein the silver halide photographic photosensitive material contains at least one compound represented by the following general formula (A) and at least one compound represented by the following general formula (2):

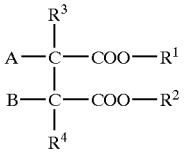

wherein in general formula (A), $R^1$ and $R^2$ each independently represent a fluoroalkyl group having from 2 to 6 carbon atoms and from 1 to 11 fluorine atoms; $R^3$ and $R^4$ each independently represents a hydrogen atom or an alkyl group; one of A and B represents a hydrogen atom, and the other represents —$L_b$—$SO_3M$; M represents a hydrogen atom or a cation; and $L_b$ represents a single bond or a substituted or unsubstituted alkylene group, General Formula (2)

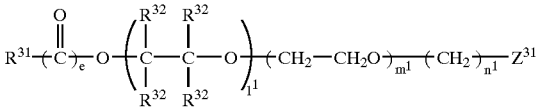

wherein in general formula (2), $R^{31}$ represents an alkyl group having from 6 to 25 carbon atoms or an alkenyl group having from 6 to 25 carbon atoms; $R^{32}$ may be the same or different, and each represents a hydrogen atom, an alkyl group having from 1 to 14 carbon atoms, an alkenyl group having from 1 to 14 carbon atoms, an aralkyl group having from 7 to 20 carbon atoms, or an aryl group having from 6 to 18 carbon atoms; $l^1$ represents an integer from 1 to 10; $m^1$ represents an integer from 0 to 30; $n^1$ represents an integer from 0 to 4; e represents 0 or 1; $Z^{31}$ represents $OSO_3M$ or $SO_3M$; and M represents a cation.

5. The silver halide photographic photosensitive material of claim 1, wherein at least one of a front surface and a back surface has a surface electric resistance of $10^{10}\Omega$ to $10^{15}\Omega$.

6. The silver halide photographic photosensitive material of claim 1, further comprising a hydrophilic colloid layer containing a colloid, in addition to the surface protective layer.

7. The silver halide photographic photosensitive material of claim 6, wherein at least one of the surface protective layer and the hydrophilic colloid layer contains at least one nonionic surfactant represented by the following general formula (4):

General Formula (4)

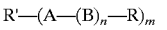

wherein in general formula (4), m represents 1 or 2; n represents an integer from 1 to 60; R represents a hydrogen atom or a linear or branched alkyl group having from 1 to 4 carbon atoms; R' represents a substituted or unsubstituted alkyl group having from 1 to 30 carbon atoms, a substituted or unsubstituted alkenyl group having from 1 to 30 carbon atoms, or a substituted or unsubstituted aryl group having from 1 to 30 carbon atoms; A represents —O—, —S—, —COO—, —N($R_1$)—, —CO—N($R_1$)— or —$SO_2$—N($R_1$)—; $R_1$ represents a hydrogen atom or a substituted or unsubstituted alkyl group; and B represents an oxyalkylene group.

8. The silver halide photographic photosensitive material of claim 4, wherein the compound represented by general formula (A) is a compound represented by the following general formula (B):

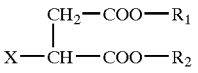

wherein in general formula (B), $R_1$ and $R_2$ each independently represent a fluoroalkyl group represented by $—L_a—R_{af}—W$, in which $L_a$ represents a substituted or unsubstituted alkylene group, a substituted or unsubstituted alkyleneoxy group, or a divalent group formed by combining of these groups, $R_{af}$ represents a perfluoroalkylene group having from 1 to 5 carbon atoms, and W represents a hydrogen atom, a fluorine atom or an alkyl group; and X represents $—L_b—SO_3M$, in which $L_b$ represents a methylene group or a single bond, and M represents a cation.

9. The silver halide photographic photosensitive material of claim 1, wherein a ratio of a fluorescent X-ray intensity of fluorine to a fluorescent X-ray intensity of carbon (F/C) on at least one of a front surface and a back surface of the silver halide photosensitive material is from 0.01 to 10.

10. The silver halide photographic photosensitive material of claim 4, wherein at least one of a front surface and a back surface has a surface electric resistance of $10^{10}\Omega$ to $10^{15}\Omega$.

11. The silver halide photographic photosensitive material of claim 4, further comprising a hydrophilic colloid layer containing a colloid, in addition to the surface protective layer.

12. The silver halide photographic photosensitive material of claim 4, wherein at least one of the surface protective layer and the hydrophilic colloid layer contains at least one nonionic surfactant represented by the following general formula (4):

$$R'—(A—(B)_n—R)_m \qquad \text{General Formula (4)}$$

wherein in general formula (4), m represents 1 or 2; n represents an integer from 1 to 60; R represents a hydrogen atom or a linear or branched alkyl group having from 1 to 4 carbon atoms; R' represents a substituted or unsubstituted alkyl group having from 1 to 30 carbon atoms, a substituted or unsubstituted alkenyl group having from 1 to 30 carbon atoms, or a substituted or unsubstituted aryl group having from 1 to 30 carbon atoms; A represents —O—, —S—, —COO—, $—N(R_1)—$, $—CO—N(R_1)—$ or $—SO_2—N(R_1)—$; $R_1$ represents a hydrogen atom or a substituted or unsubstituted alkyl group; and B represents an oxyalkylene group.

13. The silver halide photographic photosensitive material of claim 4, wherein a ratio of a fluorescent X-ray intensity of fluorine to a fluorescent X-ray intensity of carbon (F/C) on at least one of a front surface and a back surface of the silver halide photosensitive material is from 0.01 to 10.

* * * * *